US007396111B2

(12) United States Patent
Watanabe et al.

(10) Patent No.: US 7,396,111 B2
(45) Date of Patent: Jul. 8, 2008

(54) INKJET HEAD AND INKJET PRINTER

(75) Inventors: Hidetoshi Watanabe, Tokoname (JP); Atsushi Hirota, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 272 days.

(21) Appl. No.: 10/913,491

(22) Filed: Aug. 9, 2004

(65) Prior Publication Data

US 2005/0036013 A1 Feb. 17, 2005

(30) Foreign Application Priority Data

Aug. 11, 2003 (JP) ..... 2003-291265

(51) Int. Cl.
*B41J 2/045* (2006.01)
*B41J 2/16* (2006.01)

(52) U.S. Cl. ..... 347/50; 347/71

(58) Field of Classification Search ..... 347/50, 347/68–72

See application file for complete search history.

(56) References Cited

U.S. PATENT DOCUMENTS

| | | | | |
|---|---|---|---|---|
| 5,087,930 | A | 2/1992 | Roy et al. | |
| 5,406,318 | A | 4/1995 | Moore et al. | |
| 5,963,234 | A | 10/1999 | Miyazawa et al. | |
| 6,631,981 | B2 | 10/2003 | Isono et al. | |
| 6,979,074 | B2 * | 12/2005 | Watanabe et al. | 347/50 |
| 7,004,565 | B2 * | 2/2006 | Suzuki et al. | 347/50 |
| 2002/0003560 | A1 * | 1/2002 | Isono et al. | 347/72 |

FOREIGN PATENT DOCUMENTS

| | | |
|---|---|---|
| EP | 0 426 473 A2 | 5/1991 |
| EP | 0 518 700 A2 | 12/1992 |
| EP | 0 759 361 A2 | 2/1997 |
| JP | A 3-150165 | 6/1991 |
| JP | A 9-314836 | 12/1997 |
| JP | A 2000-254657 | 9/2000 |
| JP | A-2001-113700 | 4/2001 |
| JP | A-2002-19102 | 1/2002 |
| JP | A-2003-165215 | 6/2003 |

* cited by examiner

*Primary Examiner*—Stephen D. Meier
*Assistant Examiner*—Geoffrey Mruk
(74) *Attorney, Agent, or Firm*—Oliff & Berridge, PLC

(57) ABSTRACT

An inkjet head including piezoelectric sheets each of which has an individual electrode-forming region on its front surface, and inner electrodes in its inside. Individual electrodes are arranged in the individual electrode-forming region. The inner electrodes are arranged opposite to the individual electrodes. Front surface common electrodes are provided on the front surface of the piezoelectric sheet so that the front surface common electrodes are formed as land portions disposed around the individual electrode-forming region. The front surface common electrodes are formed to extend lengthwise along outer edges of the individual electrode-forming region. One end portion of front surface common electrode in the lengthwise direction is connected to a connection terminal of a board connected to a drive circuit. The other end portion of front surface common electrode is electrically connected to a corresponding inner electrode via through-hole formed below the front surface common electrode.

11 Claims, 20 Drawing Sheets

INKJET HEAD AND INKJET PRINTER

BACKGROUND OF THE INVENTION

1. Field of the Invention

The present invention relates to an inkjet head and an inkjet printer using the same.

2. Description of the Related Art

There has been heretofore known an inkjet head of the type for driving a piezoelectric device to press ink packed in a pressure chamber adjacent to the piezoelectric device to eject ink from a nozzle connected to the pressure chamber toward a recording medium such as paper to thereby form an image on the recording medium.

For example, an inkjet head disclosed in JP-A-Hei3-150165 includes a cavity plate having columns of rhombic pressure chambers. A common electrode which is common to the pressure chambers of the cavity plate is provided on a pressure chamber side surface of the cavity plate in the inkjet head. A sheet-like piezoelectric device having individual electrodes (drive electrodes) corresponding to the pressure chambers is laminated on a surface of the cavity plate opposite to the pressure chamber side surface. The inkjet head is provided so that a drive voltage is applied between a certain individual electrode and the common electrode to displace the piezoelectric device toward the pressure chamber side to press ink in the pressure chamber to thereby eject ink from a nozzle connected to the pressure chamber.

Incidentally, in this type inkjet head, wiring from the individual and common electrodes to a drive circuit is complex because the common electrode is provided on a surface opposite to the individual electrodes. It is therefore conceived that lands separated from the individual electrodes are provided on the individual electrode side surface of the piezoelectric device so that the common electrode can be electrically connected to the lands through through-holes.

When the common electrode is connected to the lands through the through-holes in this manner, the individual and common electrodes can be electrically connected to the drive circuit without complex wiring except that a board having a wiring layer (pads) connected to the drive circuit is placed on a front surface of the piezoelectric device so that the individual electrodes and the lands are bonded to the wiring layer.

If the lands and the through-holes are provided on and in the piezoelectric device, the lands and the through-holes cause deformation unevenness of the piezoelectric device in regions in which the individual electrodes are adjacent to the lands. As a result, ink ejection characteristic varies in accordance with nozzles corresponding to the individual electrodes. If the connection routes (through-holes) for connecting the common electrode to the lands are provided as only one system in order to suppress deformation unevenness, durability/reliability of products is lowered because there is no preparatory wiring for accidents such breaking of wire.

SUMMARY OF THE INVENTION

It is an object of the invention to improve durability of products and suppress variation in ink eject characteristic in an inkjet head including a piezoelectric sheet having a front surface on which individual electrodes and land portions electrically connected to an internal electrode common to the individual electrodes through through-holes are provided.

According to one aspect of the invention, an inkjet head provided includes a piezoelectric sheet which has an individual electrode-forming region having individual electrodes arranged on its front surface, and inner electrodes formed in its inside so as to be disposed opposite to the individual electrodes of the individual electrode-forming region. The piezoelectric sheet further has land portions formed on the front surface and around the individual electrode-forming region so as to be electrically connected to the inner electrodes through through-holes. The inkjet head further includes a board having connection terminals electrically connected to the individual electrodes and the land portions respectively. When a drive voltage is applied between selected one of the individual electrodes of the piezoelectric sheet and corresponding one of the land portions through the board, ink is ejected from a nozzle corresponding to the selected individual electrode.

The land portions are formed so as to extend lengthwise along outer edges of the individual electrode-forming region. Each of the land portions is electrically connected to corresponding one of the connection terminals of the board in such a manner that one end portion of the land portion in the lengthwise direction is connected to the connection terminal. Each of the land portions is electrically connected to corresponding one of the inner electrodes in such a manner that the other end portion of the land portion is connected to corresponding one of the through-holes formed below the land portion.

By thus configuration, each of the land portions is formed so as to extend lengthwise along the outer edge of the individual electrode-forming region so that the front surface area of the land portion can be made large without necessity of widening the land portion on the individual electrode-forming region side. Accordingly, variation in ink ejection characteristic of the nozzles can be suppressed while the bonding area between the connection terminal of the board and the land portion can be kept sufficiently large.

By thus configuration, that is, electrical connection between the board and each land portion (accordingly, between the board and each inner electrode) can be kept good because the bonding area is large. Moreover, because the land portions and the through-holes can be provided so as to be sufficiently far from the individual electrode-forming region, an inkjet head high in performance and high in durability can be provided.

According to another aspect of the invention, the land portions are connected to the through-holes formed below the land portions respectively so that a plurality of connection routes can be provided for connecting the board to the inner electrodes. Accordingly, even in the case where one connection route is broken, electrical connection between the board and each inner electrode can be kept by another connection route.

According to another aspect of the invention, an inkjet head may include a piezoelectric sheet having individual electrodes arranged on a column. An inkjet head may include a piezoelectric sheet having individual electrodes arranged in the form of a matrix (i.e. two-dimensionally).

According to another aspect of the invention, the individual electrodes may be arranged in the form of a matrix in the individual electrode-forming region of the piezoelectric sheet by thus configuration, durability and reliability of products can be improved in an inkjet head having individual electrodes arranged in the form of a matrix.

According to another aspect of the invention, in the inkjet head, each of the land portions has a land body portion formed so as to extend lengthwise along an outer edge of the individual electrode-forming region, and an extension portion extending from one end portion of the land body portion to the end edge side of the piezoelectric sheet. Each of the land portions is electrically connected to corresponding one of the connection terminals of the board in such a manner that a curved portion which is a boundary region between the land body portion and the extension portion is connected to the connection terminal. Each of the land portions is electrically connected to corresponding one of the inner electrodes in such a manner that the other end portion of the land body portion is connected to corresponding one of the through-holes formed below the land portion.

By thus configuration, the land body portions are formed so as to extend lengthwise along outer edges of the individual electrode-forming region, so that the front surface area of each land portion can be made large without necessity of disposing the land portion near the individual electrode-forming region. Accordingly, electrical connection between the board and each land portion (accordingly, between the board and each inner electrode) can be kept good. Moreover, variation in ink ejection characteristic of the nozzles can be suppressed.

Particularly, the extension portion is provided in a region between each land body portion and an end edge of the piezoelectric sheet so that the area of the land portion connected to the connection terminal of the board can be made large. Accordingly, electrical connection between the board and each land portion (accordingly, between the board and each inner electrode) can be kept better. Hence, durability and reliability of products can be improved more greatly.

According another aspect of the invention, in the inkjet head, protrusive contact portions may be provided in sites which are of the individual electrodes and the land portions and which are connected to the connection terminals of the board. When the protrusive contact portions are provided, a small gap is formed between the piezoelectric sheet and the board when the piezoelectric sheet and the board are bonded while disposed opposite to each other. Hence, even in the case where small dust or the like is deposited on the piezoelectric sheet, the piezoelectric sheet and the board can be prevented from being injured by the dust at the time of bonding. Hence, reliability of products can be improved so that yield of products can be improved.

According to another aspect of the invention, the contact portions provided for the individual electrodes may be substantially leveled with the contact portions provided for the land portions. The contact portions of the land portions and the contact portions of the individual electrodes can be evenly connected to the board.

Accordingly, local load can be prevented from being applied on the board and the piezoelectric sheet at the time of assembling, so that contact failure can be prevented from occurring in the contact portions. Moreover, because the contact portions are leveled with one another, electrical characteristic between each contact portion and a corresponding connection terminal of the board can be made uniform. Accordingly, variation in ink ejection characteristic can be suppressed.

According to another aspect of the invention, when the contact portions provided for the individual electrodes and the contact portions provided for the land portions are soldered to the connection terminals provided on the board, preferably, the front surface areas of the contact portions may be made substantially equal to one another. If the front surface areas of the contact portions are different from one another, the amount of solder deposited on each contact portion varies when the contact portions are soldered to the connection terminals of the board. In such a case, there will occur contact portions imperfectly soldered because the amount of solder is too large to be molten completely and contact portions imperfectly soldered because the amount of solder is too small to be kept nonvolatile.

When the front surface areas are made substantially equal to one another, the amounts of solder in the contact portions can be made so uniform that imperfect bonding can be prevented from occurring in the contact portions. Hence, an inkjet head high in durability and reliability can be produced. Incidentally, when the difference between the front surface areas of the contact portions is so small that the amounts of solder can be made uniform sufficiently to avoid imperfect bonding in the contact portions, the area difference can be allowed so that the front surface areas are regarded as being substantially equal to one another.

In the inkjet head, a cavity plate having pressure chambers located in positions corresponding to the individual electrodes respectively and opened to the piezoelectric sheet side is bonded to a rear surface of the piezoelectric sheet. Preferably, the contact portions provided for the individual electrodes and the contact portions provided for the land portions may be provided with respect to the cavity plate as in a seventh configuration of the invention.

According to another aspect of the invention, the contact portions provided for the individual electrodes and the contact portions provided for the land portions are disposed on part of the front surface of the piezoelectric sheet opposite to a bonding surface of the cavity plate bonded to the rear surface of the piezoelectric sheet.

Regions of the front surface of the cavity plate in which there is no pressure chamber formed (i.e. surrounding regions of pressure chambers) form a bonding surface between the piezoelectric sheet and the cavity plate. If the contact portions of the individual electrodes and the contact portions of the land portions are arranged on the front surface of the piezoelectric sheet opposite to the pressure chambers (i.e. on the pressure chambers), pressing force is applied on the piezoelectric sheet through the contact portions when the board is mounted on the piezoelectric sheet while placed on the piezoelectric sheet. As a result, there is a problem that regions of the piezoelectric sheet not supported by the cavity plate are distorted and injured.

According the seventh configuration, the contact portions of the individual electrodes and the contact portions of the land portions are arranged on the bonding surface of the cavity plate on the front surface of the piezoelectric sheet, the piezoelectric sheet can be prevented from being injured when the board is mounted on the piezoelectric sheet while placed on the piezoelectric sheet. Hence, in accordance with the inkjet head having the seventh configuration, yield of products can be improved.

Although the configuration of the inkjet head has been described above, an inkjet printer good in image quality and excellent in durability can be provided when the inkjet head is used for forming the inkjet printer. Moreover, because yield of inkjet heads is improved, the inkjet head can be provided inexpensively.

DESCRIPTION OF THE PREFERRED EMBODIMENTS

Figure 1:
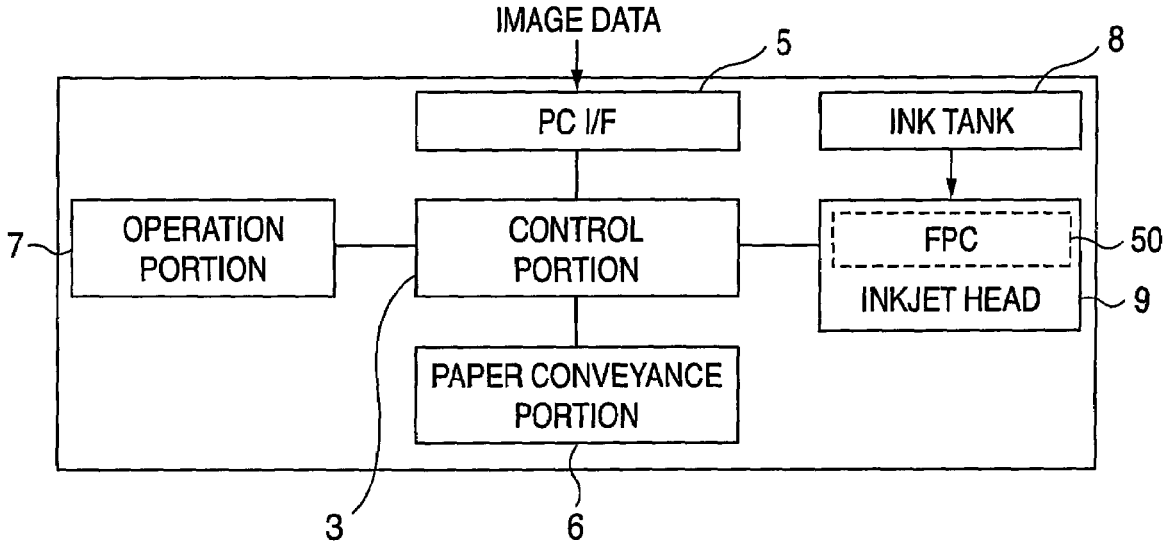
FIG. 1 is a block diagram showing the schematic configuration of an inkjet printer 1 to which the invention is applied.

An embodiment of the invention will be described below with reference to the drawings. FIG. 1 is a block diagram showing the configuration of an inkjet printer 1 provided with an inkjet head 9 to which the invention is applied.

In this embodiment, the inkjet printer 1 includes a control portion 3 composed of a micro-computer, etc., a PC interface 5 represented by a USB interface etc., a paper conveyance portion 6 composed of a feed roller, etc., an operation portion 7 provided with various keys necessary for a user to operate the inkjet printer 1, an ink tank 8 filled with ink, and the inkjet head 9 connected to the ink tank 8 so that ink supplied from the ink tank 8 is ejected as ink droplets from nozzles 111.

A personal computer (PC) or the like is connected to the inkjet printer 1 through the PC interface 5. Upon reception of image data from the outside (PC) through the PC interface 5, the control portion 3 for generally controlling the inkjet printer 1 controls the paper conveyance portion 6 to take a sheet of paper from a paper tray not shown and convey the sheet of paper to the inkjet head 9 side.

On the other hand, the control portion 3 controls the inkjet head 9 to make the inkjet head 9 scan in a main scanning direction and eject ink droplets from the nozzles 111 of the inkjet head 9 on the basis of the image data acquired from the outside (PC) so that an image is formed on the sheet of paper by use of the ink droplets based on the image data acquired from the outside (PC). On this occasion, the sheet of paper is conveyed in a sub scanning direction interlockingly with the operation of the inkjet head 9. After the formation of the image, the control portion 3 discharges the sheet of paper having the image formed thereon to a not-shown paper delivery tray and terminates the printing process.

Figure 2:
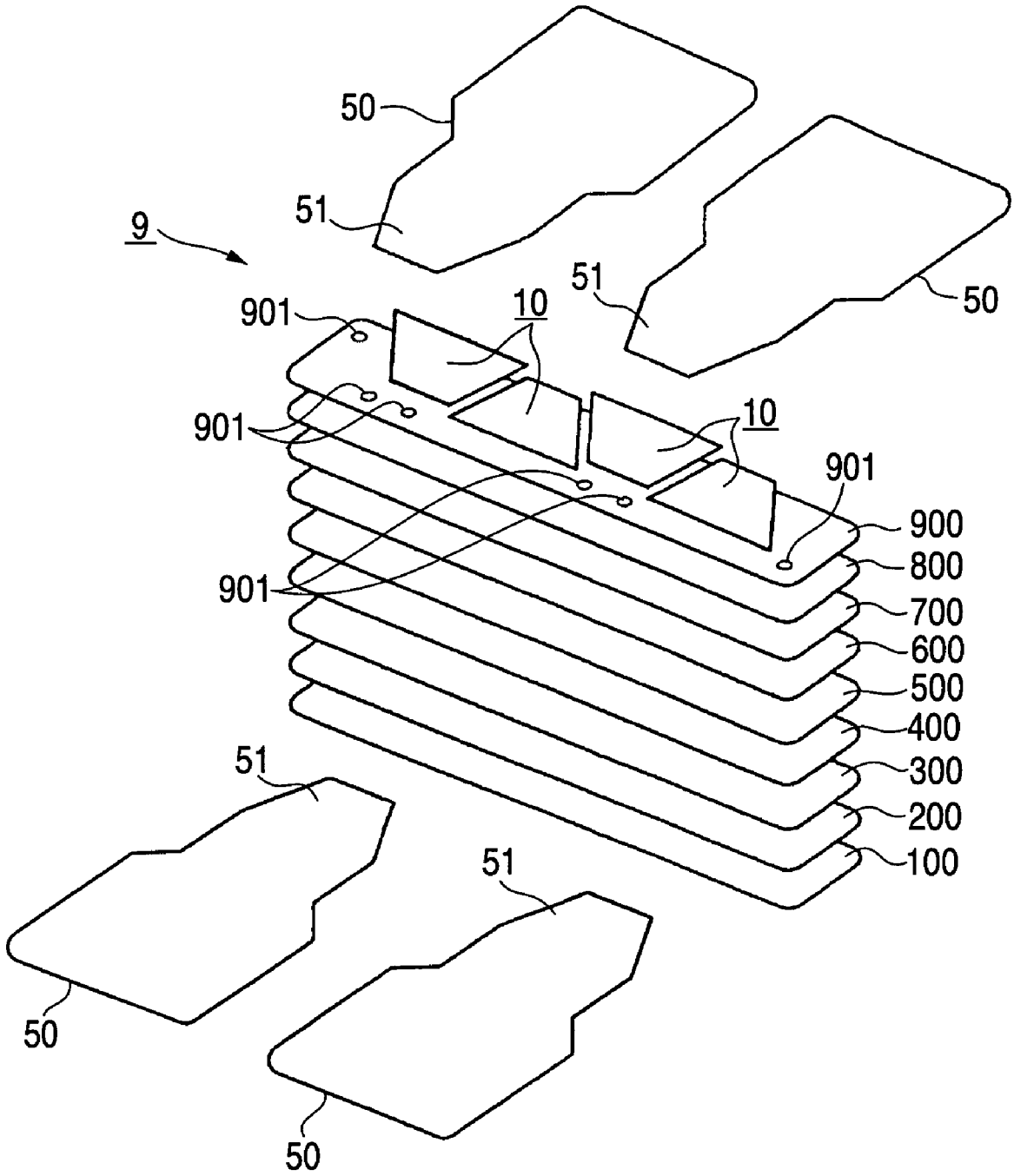
FIG. 2 is an exploded perspective view showing the schematic configuration of an inkjet head 9.
Figure 3:
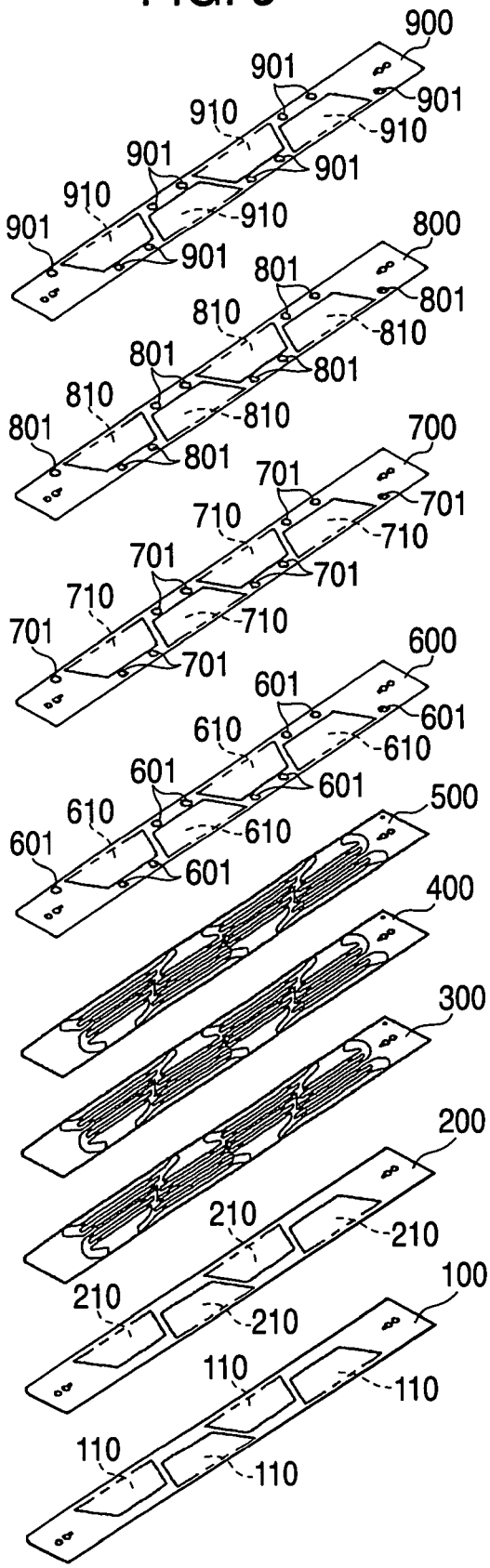
FIG. 3 is an exploded perspective view showing the laminated structure of the inkjet head 9.
Figure 4:
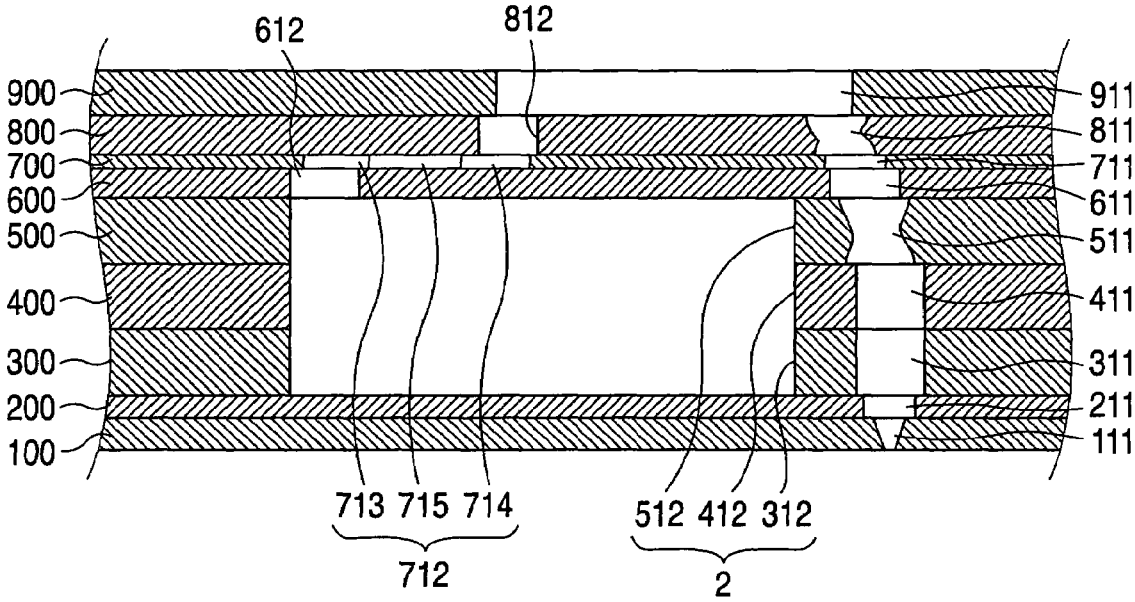
FIG. 4 is a schematic sectional view showing the laminated structure of the inkjet head 9.

FIG. 2 is an exploded perspective view showing the schematic configuration of the inkjet head 9 provided in the inkjet printer 1. FIG. 3 is an exploded perspective view showing the laminated structure of the inkjet head 9. FIG. 4 is a schematic section view showing the laminated structure of the inkjet head 9.

The inkjet head 9 according to this embodiment has a structure in which thin metal plates each substantially shaped like a rectangle are laminated on one another. Specifically, the inkjet head 9 has a nine-layer structure in which nine thin metal plates each substantially shaped like a rectangle are laminated on one another. That is, as shown in FIGS. 2 to 4, a nozzle plate 100, a cover plate 200, a first manifold plate 300, a second manifold plate 400, a third manifold plate 500, a supply plate 600, an aperture plate 700, a base plate 800 and a cavity plate 900 are laminated on one another in ascending order.

Four piezoelectric sheets 10 each shaped like a nearly trapezoidal plate are laminated alternately on a front surface (i.e., top surface) of the cavity plate 900 so that the four piezoelectric sheets 10 do not overlap one another. Front end portions 51 of flexible printed circuit boards (hereinafter referred to as "FPC boards") 50 are placed on the upper side of the piezoelectric sheets 10 so that the FPC boards 50 are electrically connected to the piezoelectric sheets 10. Incidentally, ink supply holes 901 connected to the ink tank 8 are provided in the cavity plate 900 so as to be disposed around the piezoelectric sheets 10 laminated on the cavity plate 900.

Figure 5:
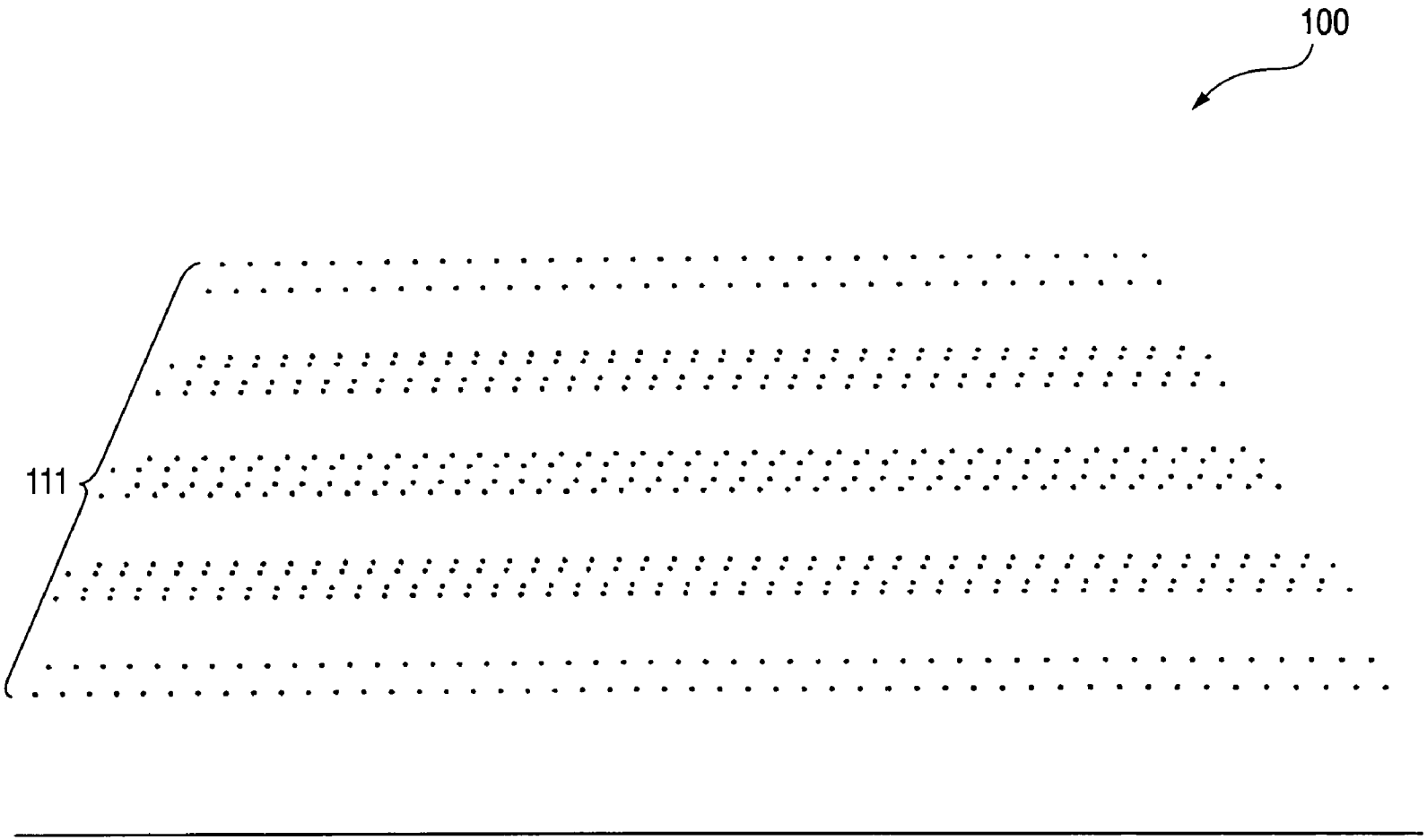
FIG. 5 is a plan view showing the configuration of a nozzle plate 100.
Figure 6:
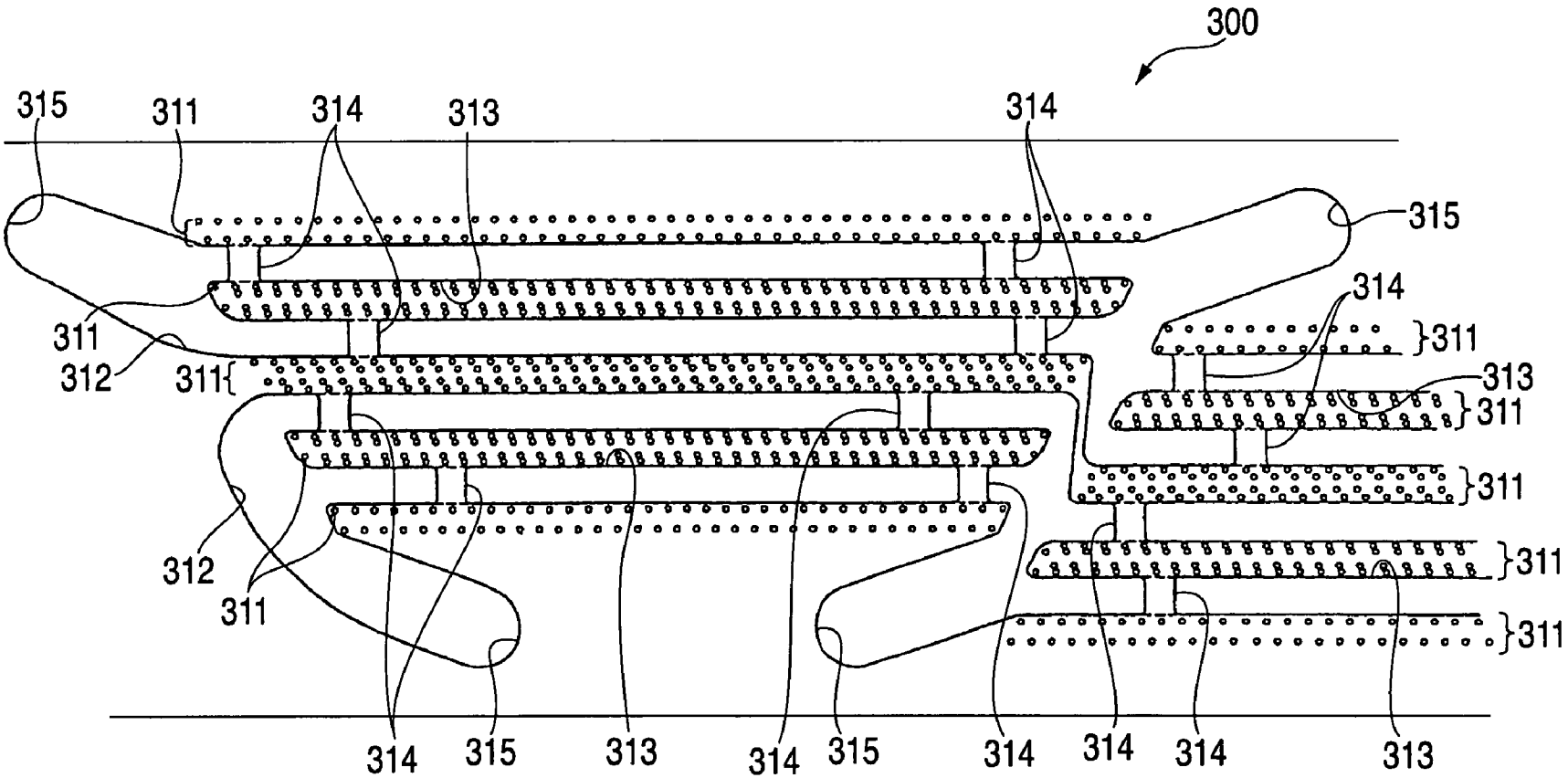
FIG. 6 is a plan view showing the front surface configuration of a first manifold plate 300.
Figure 7:
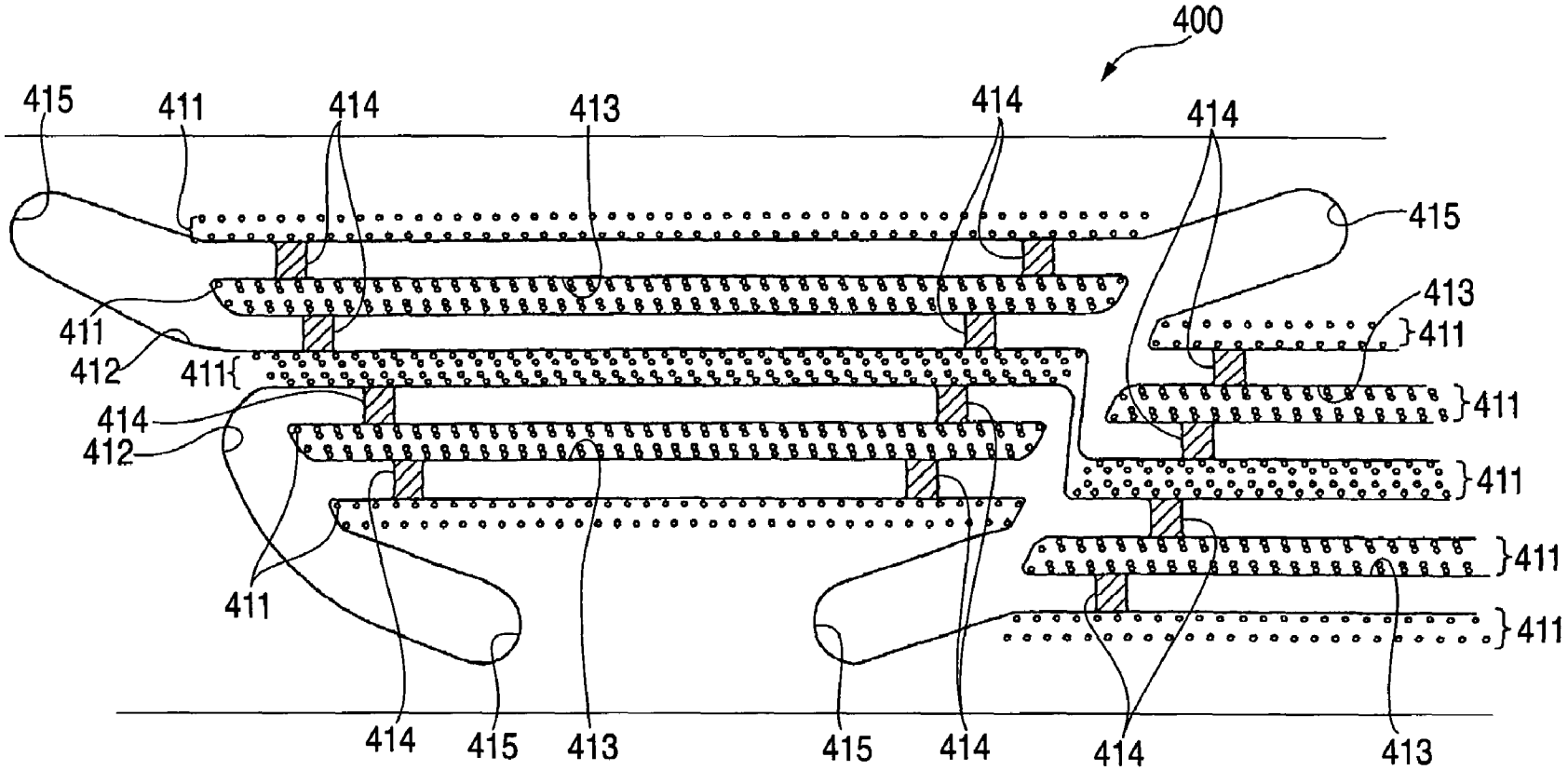
FIG. 7 is a plan view showing the front surface configuration of a second manifold plate 400.
Figure 8:
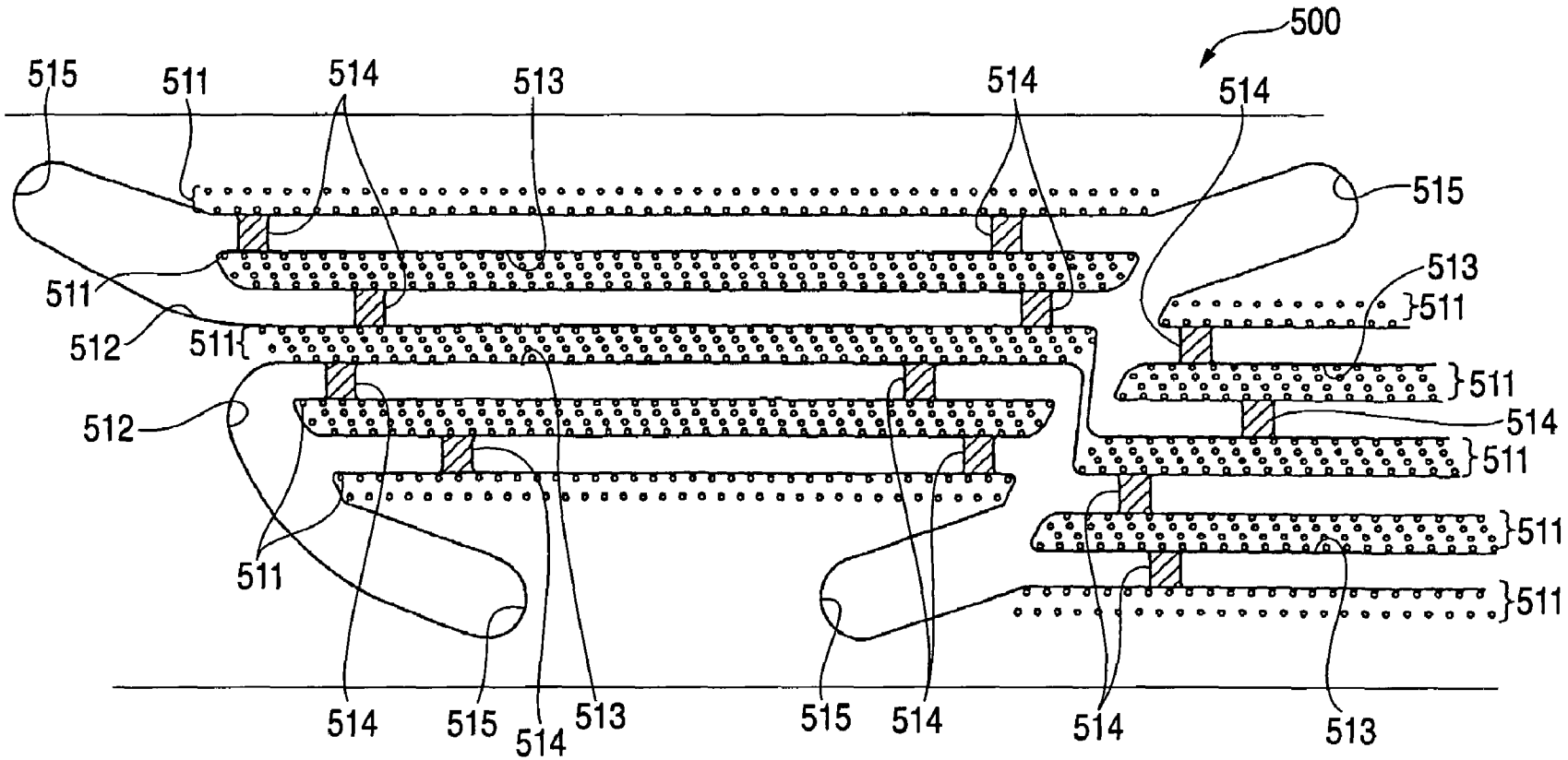
FIG. 8 is a plan view showing the front surface configuration of a third manifold plate 500.

Next, the respective plates will be described. FIG. 5 is a plan view showing the configuration of the nozzle plate 100. FIG. 6 is a plan view showing the front surface configuration of the first manifold plate 300. FIG. 7 is a plan view showing the front surface configuration of the second manifold plate 400. FIG. 8 is a plan view showing the front surface configuration of the third manifold plate 500.

As shown in FIGS. 3 to 5, four nearly trapezoidal regions 110 each having a large number of small-diameter ink ejection nozzles 111 formed as a group in accordance with required print density are provided in the nozzle plate 100. Four nearly trapezoidal regions 210 each having a large number of small-diameter ink path through-holes 211 formed as a group are provided in a front surface of the cover plate 200. The through-holes 211 of the cover plate 200 are disposed in positions opposite to the nozzles 111 of the nozzle plate 100 so that the through-holes 211 of the cover plate 200 are connected to the nozzles 111 of the nozzle plate 100 respectively when the cover plate 200 is laminated on the nozzle plate 100.

As shown in FIG. 6, a large number of small-diameter ink path through-holes 311 are formed in the first manifold plate 300. The through-holes 311 are disposed in positions opposite to the through-holes 211 of the cover plate 200 (see FIG. 4) so that the through-holes 311 are connected to the through-holes 211 of the cover plate 200 respectively when the first manifold plate 300 is laminated on the cover plate 200.

Two grooving portions 312 for forming ink manifold flow paths 2 (see FIG. 4) are further formed in the first manifold plate 300 so as to extend in the lengthwise direction. The aforementioned through-holes 311 are disposed in outer circumferences of the grooving portions 312 and in a plurality of floating islands 313 surrounded by the grooving portions 312.

The plurality of floating islands 313 are supported by a plurality of connection pieces 314 each having a half-etched lower side. Each of the connection pieces 314 is formed to have a thickness equal to about a half of the thickness of the first manifold plate 300. A plurality of ink supply portions 315 are further provided in the grooving portions 312.

As shown in FIG. 7, two grooving portions 412 for forming ink manifold flow paths 2 are formed in the second manifold plate 400 so as to extend in the lengthwise direction. The grooving portions 412 of the second manifold plate 400 are disposed in positions opposite to the grooving portions 312 of the first manifold plate 300 so that the grooving portions 412 of the second manifold plate 400 are connected to the grooving portions 312 of the first manifold plate 300 respectively when the second manifold plate 400 is laminated on the first manifold plate 300 (see FIG. 4).

A large number of small-diameter ink path through-holes 411 are formed in outer circumferences of the grooving portions 412 and in a plurality of floating islands 413 surrounded by the grooving portions 412. The through-holes 411 of the second manifold plate 400 are disposed in positions opposite to the through-holes 311 of the first manifold plate 300 so that the through-holes 411 of the second manifold plate 400 are connected to the through-holes 311 of the first manifold plate 300 respectively when the second manifold plate 400 is laminated on the first manifold plate 300.

The floating islands 413 are supported by connection pieces 414 each having a half-etched upper side. Incidentally, each of the connection pieces 414 is formed to have a thickness equal to about a half of the thickness of the second manifold plate 400.

A plurality of ink supply portions 415 are further provided in the grooving portions 412 so as to extend. The ink supply portions 415 of the second manifold plate 400 are disposed in positions opposite to the ink supply portions 315 of the first manifold plate 300 so that the ink supply portions 415 of the second manifold plate 400 are connected to the ink supply portions 315 of the first manifold plate 300 respectively when the second manifold plate 400 is laminated on the first manifold plate 300.

As shown in FIG. 8, two grooving portions 512 for forming ink manifold flow paths 2 are formed in the third manifold plate 500 so as to extend in the lengthwise direction. The grooving portions 512 of the third manifold plate 500 are disposed in positions opposite to the grooving portions 412 of the second manifold plate 400 so that the grooving portions 512 of the third manifold plate 500 are connected to the grooving portions 412 of the second manifold plate 400 respectively when the third manifold plate 500 is laminated on the second manifold plate 400.

A large number of small-diameter ink path through-holes 511 are formed in outer circumferences of the grooving portions 512 and in a plurality of floating islands 513 surrounded by the grooving portions 512. The through-holes 511 of the third manifold plate 500 are disposed in positions almost opposite to the through-holes 411 of the second manifold plate 400 so that the through-holes 511 of the third manifold plate 500 are connected to the through-holes 411 of the second manifold plate 400 respectively when the third manifold plate 500 is laminated on the second manifold plate 400.

The floating islands 513 are supported by connection pieces 514 each having a half-etched upper side. Incidentally, each of the connection pieces 514 is formed to have a thickness equal to about a half of the thickness of the third manifold plate 500.

A plurality of ink supply portions 515 are further provided in the grooving portions 512 so as to extend. The ink supply portions 515 of the third manifold plate 500 are disposed in positions opposite to the ink supply portions 415 of the second manifold plate 400 so that the ink supply portions 515 of the third manifold plate 500 are connected to the ink supply portions 415 of the second manifold plate 400 respectively when the third manifold plate 500 is laminated on the second manifold plate 400.

Figure 9A:
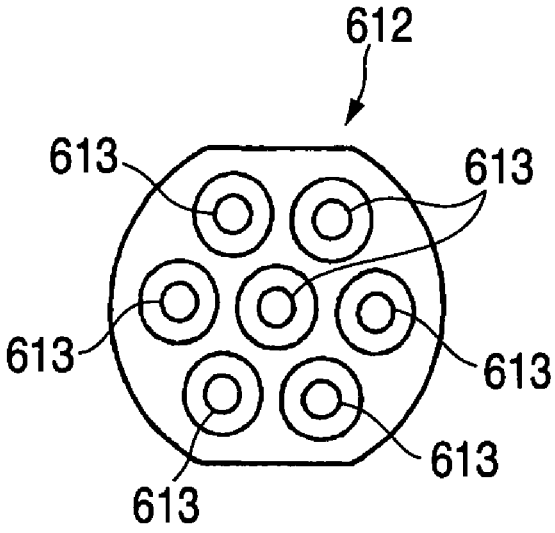
FIG. 9A is an enlarged plan view showing the configuration of an ink introduction through-hole 612 provided in a supply plate 600.
Figure 9B:
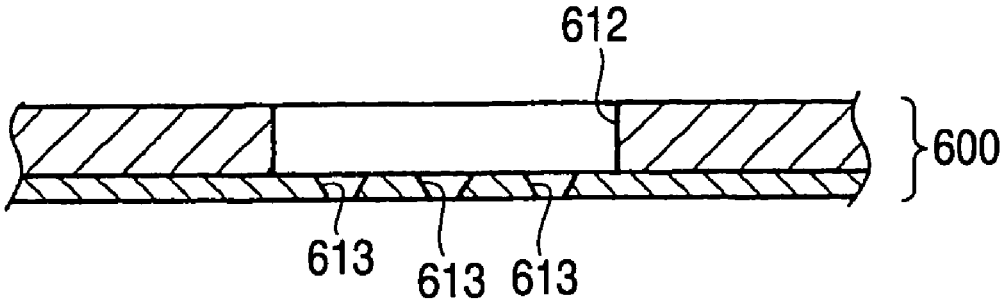
FIG. 9B is an enlarged sectional view showing the configuration of the through-hole 612.
Figure 10:
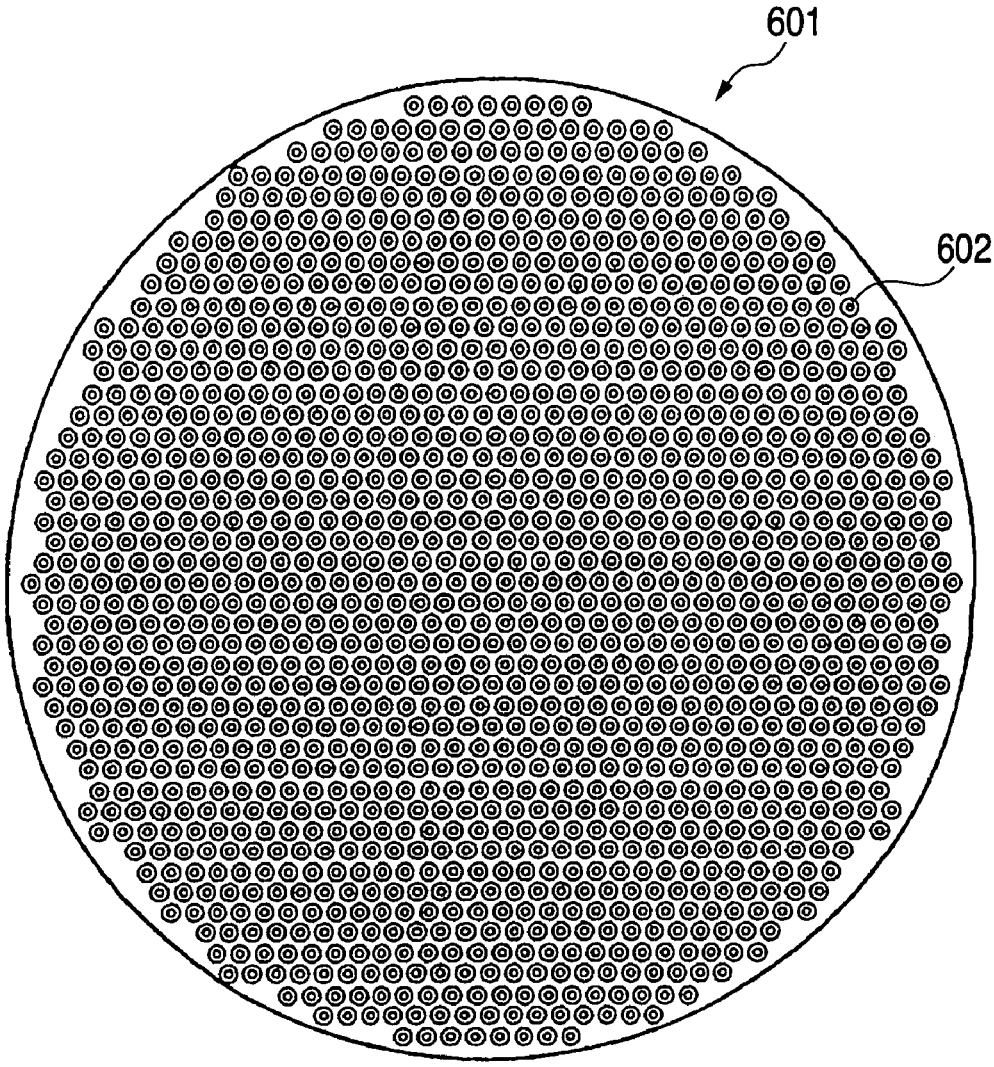
FIG. 10 is an enlarged plan view showing the configuration of an ink supply hole 601 provided in the supply plate 600.
Figure 11:
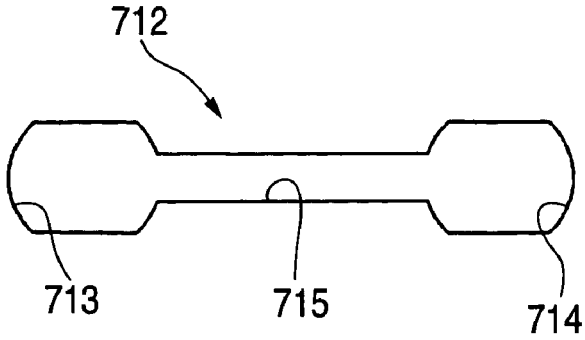
FIG. 11 is a plan view showing the configuration of an ink introduction throttle portion 712 provided in an aperture plate 700.
Figure 12:
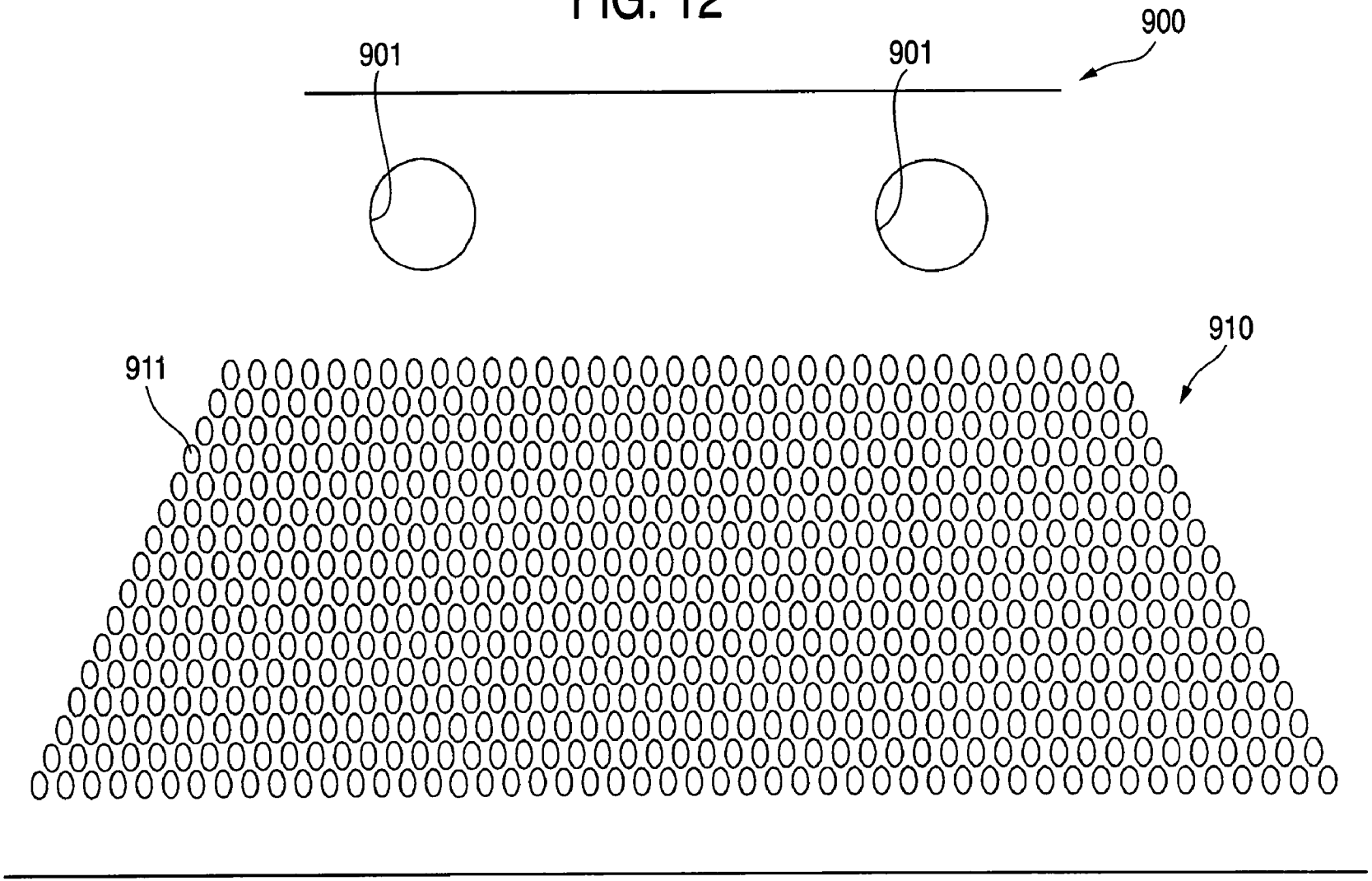
FIG. 12 is a plan view showing the front surface configuration of a cavity plate 900.

Next, the supply plate 600, the aperture plate 700, the base plate 800 and the cavity plate 900 will be described. FIG. 9A is an enlarged plan view of each through-hole 612 provided in the supply plate 600. FIG. 9B is an enlarged sectional view of the through-hole 612. FIG. 10 is an enlarged plan view of each ink supply hole 601 provided in the supply plate 600. FIG. 11 is a plan view showing the configuration of an ink introduction throttle portion 712 provided in the aperture plate 700. FIG. 12 is a plan view showing the front surface configuration of the cavity plate 900.

Four nearly trapezoidal regions 610 (see FIG. 3) are provided in the supply plate 600 so that each nearly trapezoidal region 610 forms a group. A large number of small-diameter ink path through-holes 611 and a large number of small-diameter ink introduction through-holes 612 are provided in each nearly trapezoidal region 610 (see FIG. 4). As shown in FIGS. 9A and 9B, a large number of filter pores 613 for preventing ink from being contaminated with dust are formed in each through-hole 612 in the supply plate 600.

The through-holes 611 of the supply plate 600 are disposed in positions almost opposite to the through-holes 511 of the third manifold plate 500 so that the through-holes 611 of the supply plate 600 are connected to the through-holes 511 of the third manifold plate 500 respectively when the supply plate 600 is laminated on the third manifold plate 500.

On the other hand, the through-holes 612 of the supply plate 600 are disposed in positions opposite to any one of the two grooving portions 512 of the third manifold plate 500 so that the through-holes 612 of the supply plate 600 are connected to any one of the two grooving portions 512 of the third manifold plate 500 when the supply plate 600 is laminated on the third manifold plate 500.

A plurality of small-diameter ink supply holes 601 are further formed in the outside of each of the four nearly trapezoidal regions 610 of the supply plate 600 (see FIG. 3). The ink supply holes 601 of the supply plate 600 are disposed in positions opposite to the ink supply portions 515 of the third manifold plate 500 so that the ink supply holes 601 of the supply plate 600 are connected to the ink supply portions 515 of the third manifold plate 500 respectively when the supply plate 600 is laminated on the third manifold plate 500. As shown in FIG. 10, a large number of filter pores 602 for preventing ink from being contaminated with dust are provided in each ink supply hole 601 in the supply plate 600.

Four nearly trapezoidal regions 710 are provided in the aperture plate 700 so that each nearly trapezoidal region 710 forms a group. As shown in FIG. 4, a large number of small-diameter ink path through-holes 711 and a large number of ink introduction throttle portions 712 are provided in each nearly trapezoidal region 710. The through-holes 711 of the aperture plate 700 are disposed in positions almost opposite to the through-holes 611 of the supply plate 600 so that the through-holes 711 of the aperture plate 700 are connected to the through-holes 611 of the supply plate 600 respectively when the aperture plate 700 is laminated on the supply plate 600.

On the other hand, as shown in FIG. 11, each of the throttle portions 712 in the aperture plate 700 includes an ink inlet 713, an ink outlet 714, and a grooving portion 715 for connecting the ink inlet 713 and the ink outlet 714 to each other. The ink inlets 713 of the throttle portions 712 are disposed in positions almost opposite to the through-holes 612 of the supply plate 600 so that the ink inlets 713 of the throttle portions 712 are connected to the through-holes 612 of the supply plate 600 respectively when the aperture plate 700 is laminated on the supply plate 600.

A plurality of ink supply holes 701 are further formed in the outside of each of the four nearly trapezoidal regions 710 of the aperture plate 700 (see FIG. 3). The ink supply holes 701 of the aperture plate 700 are disposed in positions opposite to the ink supply holes 601 of the supply plate 600 so that the ink supply holes 701 of the aperture plate 700 are connected to the ink supply holes 601 of the supply plate 600 respectively when the aperture plate 700 is laminated on the supply plate 600.

Four nearly trapezoidal regions 810 are provided in the base plate 800 so that each nearly trapezoidal region 810 forms a group. A large number of small-diameter ink path through-holes 811 and a large number of small-diameter ink introduction through-holes 812 are provided in each nearly trapezoidal region 810. The through-holes 811 of the base plate 800 are disposed in positions almost opposite to the through-holes 711 of the aperture plate 700 so that the through-holes 811 of the base plate 800 are connected to the through-holes 711 of the aperture plate 700 respectively when the base plate 800 is laminated on the aperture plate 700 on the other hand, the through-holes 812 of the base plate 800 are disposed in positions opposite to the ink outlets 714 of the throttle portions 712 of the aperture plate 700 so that the through-holes 812 of the base plate 800 are connected to the ink outlets 714 of the throttle portions 712 of the aperture plate 700 respectively when the base plate 800 is laminated on the aperture plate 700.

A plurality of ink supply holes 801 are further formed in the outside of each of the four nearly trapezoidal regions 810 of the base plate 800 (see FIG. 3). The ink supply holes 801 are disposed in positions opposite to the ink supply holes 701 of the aperture plate 700 so that the ink supply holes 801 are connected to the ink supply holes 701 of the aperture plate 700 respectively when the base plate 800 is laminated on the aperture plate 700.

Four nearly trapezoidal regions 910 are provided in the cavity plate 900 so that each nearly trapezoidal region 910 forms a group. A large number of ink pressure chambers 911 are formed in each nearly trapezoidal region 910 so as to be shaped like a matrix in accordance with required print density (see FIG. 12). Each ink pressure chamber 911 is opened both to the piezoelectric sheet 10 side and to the base plate 800 side. That is, the ink pressure chambers 911 of the cavity plate 900 are arranged at regular intervals in back and forth directions and in left and right directions.

Front end portions of the ink pressure chambers 911 are disposed in positions almost opposite to the through-holes 811 of the base plate 800 so that the front end portions of the ink pressure chambers 911 are connected to the through-holes 811 of the base plate 800 respectively when the cavity plate 900 is laminated on the base plate 800 (see FIG. 4).

On the other hand, rear end portions of the ink pressure chambers 911 are disposed in positions almost opposite to the through-holes 812 of the base plate 800 so that the rear end portions of the ink pressure chambers 911 are connected to the through-holes 812 of the base plate 800 respectively when the cavity plate 900 is laminated on the base plate 800.

A plurality of ink supply holes 901 are further provided in the outside of each of the four nearly trapezoidal regions 910 of the cavity plate 900. The ink supply holes 901 of the cavity plate 900 are disposed in positions opposite to the ink supply holes 801 of the base plate 800 so that the ink supply holes 901 of the cavity plate 900 are connected to the ink supply holes 801 of the base plate 800 respectively when the cavity plate 900 is laminated on the base plate 800. Incidentally, rear surfaces of the piezoelectric sheets 10 each shaped like a nearly trapezoid are bonded to a front surface of the cavity plate 900.

Figure 13:
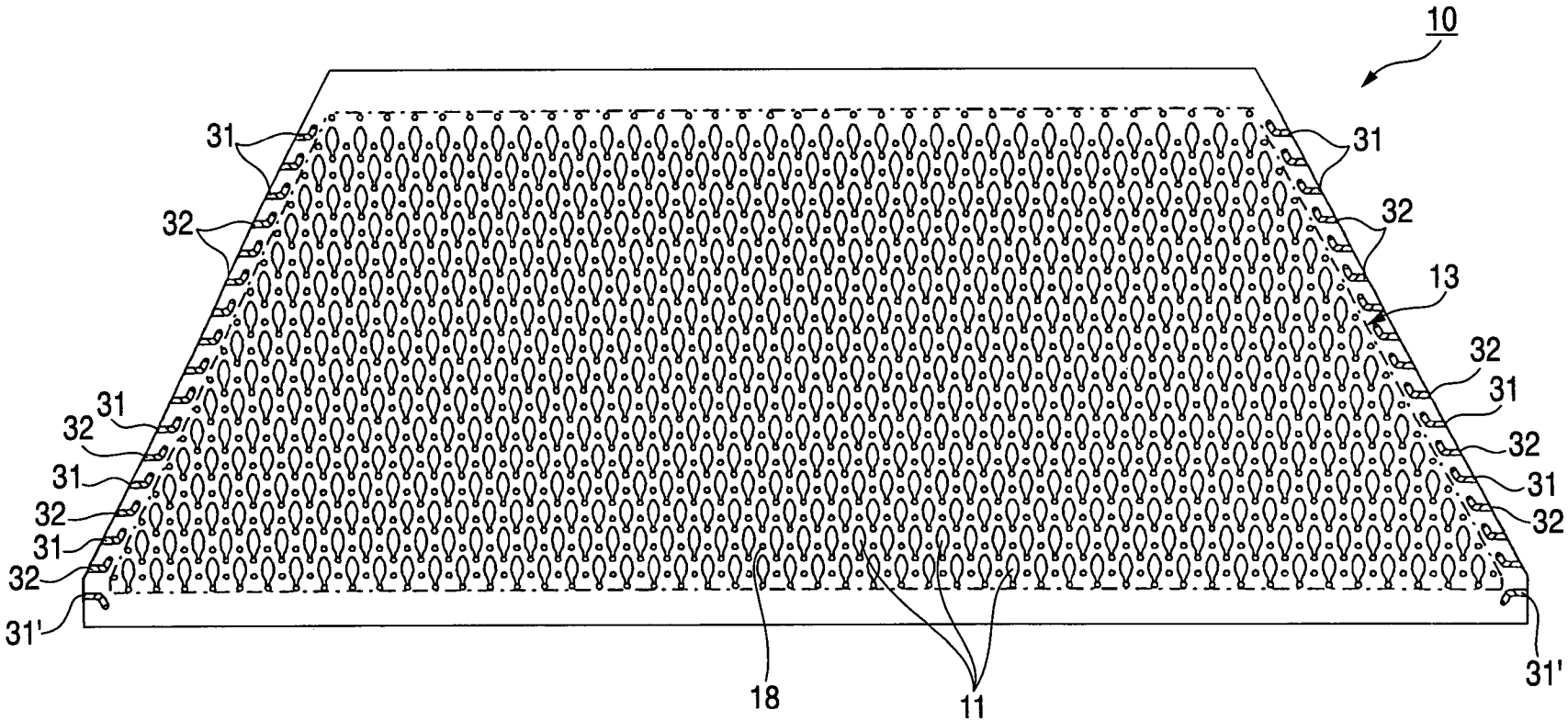
FIG. 13 is a plan view showing the front surface configuration of a piezoelectric sheet 10.
Figure 14:
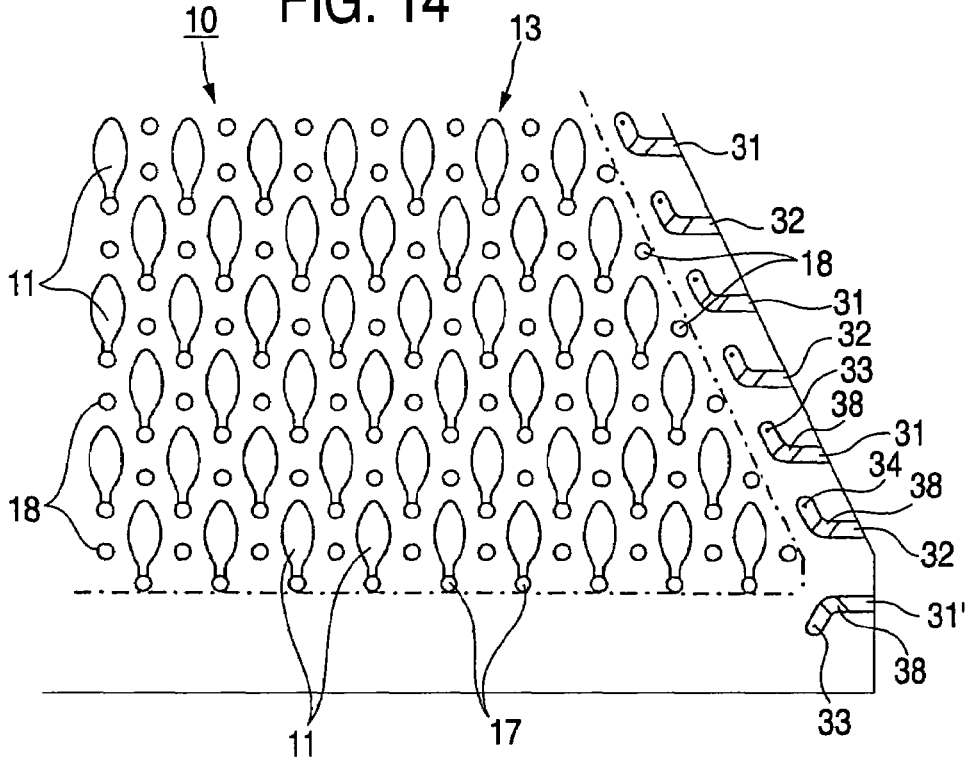
FIG. 14 is an enlarged plan view showing a right rear end portion of the front surface of the piezoelectric sheet 10.
Figure 15A:
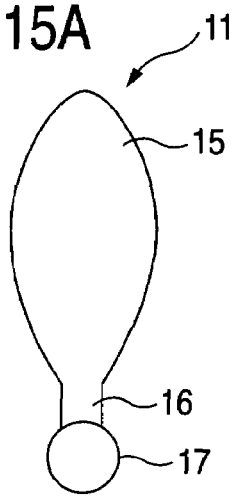
FIG. 15A is an enlarged plan view of an individual electrode 11 formed on the piezoelectric sheet 10.
Figure 15B:
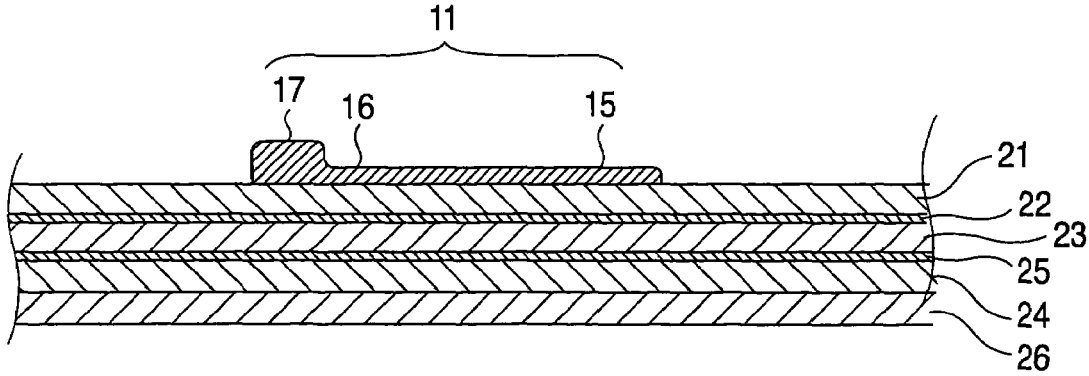
FIG. 15B is an enlarged sectional view of the individual electrode 11.
Figure 16A:
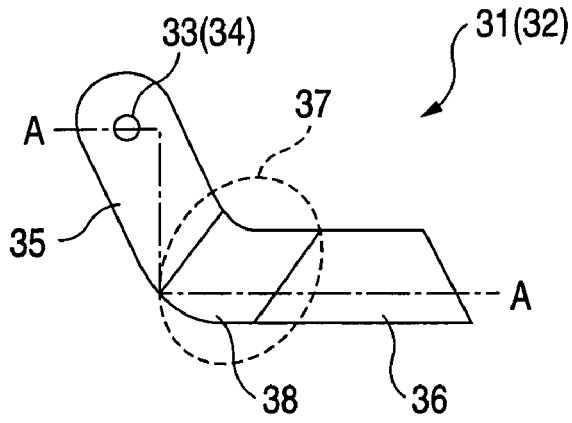
FIG. 16A is an enlarged plan view of a front surface common electrode 31 (or 32) formed on the piezoelectric sheet 10.
Figure 16B:
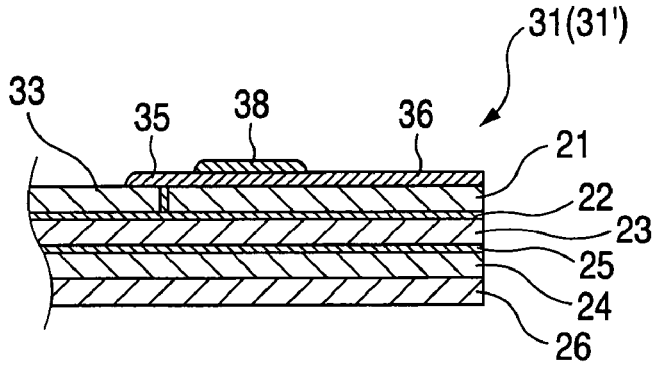
FIG. 16B is a sectional view taken along the line A-A in FIG. 16A and showing the front surface common electrode 31 (or 31')
Figure 16C:
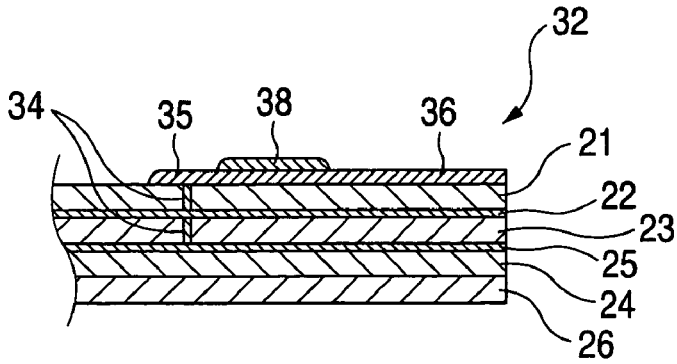
FIG. 16C is a sectional view taken along the line A-A in FIG. 16A and showing the front surface common electrode 32.
Figure 17:
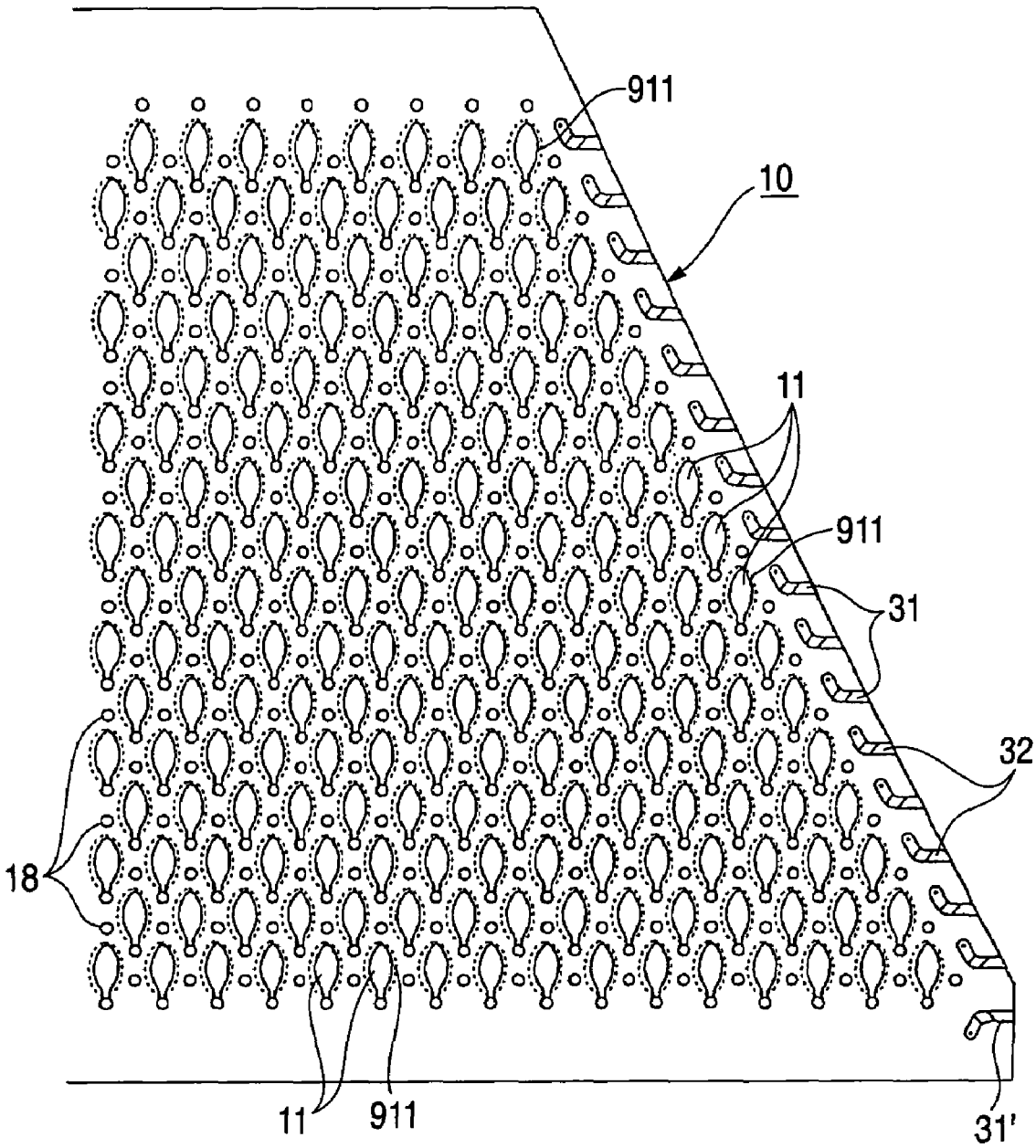
FIG. 17 is a partially see-through plan view of the piezoelectric sheet 10 showing the positional relation of ink pressure chambers 911 provided in the cavity plate 900 with various kinds of electrodes provided on the piezoelectric sheet 10.
Figure 18:
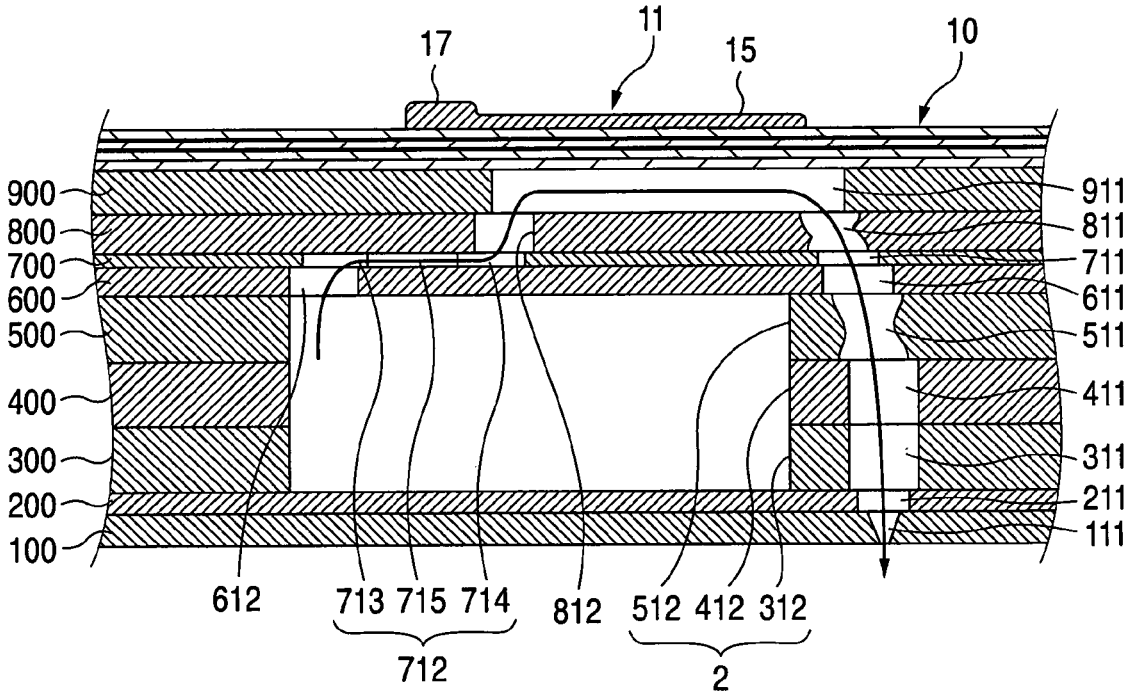
FIG. 18 is a sectional view showing the configuration of the inkjet head 9 before arrangement of an FPC board 50.

Next,the piezoelectric sheets 10 will be described. FIG. 13 is a plan view showing the front surface configuration of each piezoelectric sheet 10. FIG. 14 is an enlarged plan view showing a right rear end portion of the front surface of the piezoelectric sheet 10. FIG. 15A is an enlarged plan view showing each of individual electrodes 11 formed on the piezoelectric sheet 10. FIG. 15B is an enlarged sectional view showing the individual electrode 11. FIG. 16A is an enlarged plan view showing each of front surface common electrodes 31 (or 32) formed on the piezoelectric sheet 10. FIG. 16B is an enlarged sectional view showing the front surface common electrode 31 (or 31'). FIG. 16C is an enlarged sectional view showing the front surface common electrode 32. FIG. 17 is a partially see-through plan view of the piezoelectric sheet 10 showing the positional relation of the ink pressure chambers 911 provided in the cavity plate 900 with the individual electrodes 11 and front surface common electrodes 31 and 32 provided on the piezoelectric sheet 10. FIG. 18 is a sectional view showing the configuration of the inkjet head 9 before arrangement of the FPC boards 50.

In this embodiment, as shown in FIG. 13, a large number of individual electrodes 11 are formed on the piezoelectric sheet 10 so as to be shaped like a matrix in accordance with required print density. That is, individual electrodes 11 with the same pattern are arranged at regular intervals in an individual electrode-forming region 13 provided in the central portion of the piezoelectric sheet 10.

The individual electrodes 11 of the piezoelectric sheet 10 are disposed in positions opposite to the ink pressure chambers 911 of the cavity plate 900 respectively. When the piezoelectric sheet 10 is laminated on the cavity plate 900 so that the upper portions of the ink pressure chambers 911 of the cavity plate 900 are blocked with the piezoelectric sheet 10, the individual electrodes 11 are disposed on the upper portions of the ink pressure chambers 911 of the cavity plate 900 respectively (see FIGS. 17 and 18).

Each individual electrode 11 has an opposed portion 15 for forming a surface opposite to a corresponding ink pressure chamber 911, an extension portion 16 extending from the opposed portion 15, and a protrusive contact portion 17 formed at an end of the extension portion 16 (see FIG. 14 and FIGS. 15A and 15B). The contact portion 17 is provided on a junction surface SS between the cavity plate 900 and the piezoelectric sheet 10 as a surrounding region of the ink pressure chamber 911 in the cavity plate 900 (i.e. in a position far from the ink pressure chamber 911).

As shown in FIGS. 16A to 16C, the piezoelectric sheet 10 has a structure in which a first piezoelectric layer 21, a second piezoelectric layer 23, a third piezoelectric layer 24 and a fourth piezoelectric layer 26 are laminated on one another. In the structure, inner electrodes 22 opposite to the individual electrodes 11 in the individual electrode-forming region 13 are provided between the first piezoelectric layer 21 and the second piezoelectric layer 23 while inner electrodes 25 are provided between the second piezoelectric layer 23 and the third piezoelectric layer 24.

The inner electrodes 22 are electrically connected to the nearly L-shaped front surface common electrodes 31 and 31' formed on the front surface of the piezoelectric sheet 10, through a plurality of through-holes 33 each filled with an electrically conductive material. The inner electrodes 25 are electrically connected to the front surface common electrodes 32 formed on the front surface of the piezoelectric sheet 10, through through-holes 34. Incidentally, the front surface common electrodes 31 and 32 are provided on the front surface of the piezoelectric sheet 10 but in another region than the individual electrode-forming region 13 where the individual electrodes 11 are formed, that is, in a region equivalent to the outer circumference of the individual electrode-forming region 13.

The front surface common electrodes 31 and 32 have the same configuration except that the front surface common electrodes 31 and 32 are connected to the different types of inner electrodes 22 and 25 by the through-holes 33 and 34 respectively. Each of the front surface common electrodes 31 and 32 has a body portion 35 formed so as to extend lengthwise along each outer edge of the individual electrode-forming region 13 (i.e. each of the left and right sides of the piezoelectric sheet 10) with a predetermined distance from the individual electrode-forming region 13 to the end edge side of the piezoelectric sheet 10, and an extension portion 36 extending along each of the upper and lower sides of the piezoelectric sheet 10 from the lengthwise rear end of the body portion 35 to the end edge side of the piezoelectric sheet 10. The body portion 35 and the extension portion 36 are connected to each other so smoothly that the boundary region between the body portion 35 and the extension portion 36 is formed as a curved portion 37. A protrusive contact portion 38 is formed in the curved portion 37.

The through-hole 33 connected to the inner electrode 22 is bonded to the lengthwise front end side of the body portion 35 of the front surface common electrode 31. The through-hole 34 connected to the inner electrode 25 is bonded to the lengthwise front end side of the body portion 35 of the front surface common electrode 32. Incidentally, the contact portion 38 provided in each of the front surface common electrodes 31 and 32 is provided on a junction surface SS between the cavity plate 900 and the piezoelectric sheet 10 located around the ink pressure chamber 911 (i.e. in a position far from the ink pressure chamber 911).

The piezoelectric sheet 10 further has protrusions 18 disposed between adjacent individual electrodes 11 for transmitting pressing force onto the junction surface SS between the cavity plate 900 and the piezoelectric sheet 10 to attain uniform connection between the cavity plate 900 and the piezoelectric sheet 10. Incidentally, in this embodiment, the protrusions 18 are leveled with the contact portions 17 and 38. In this embodiment, the front surface area of each protrusion 18 is made substantially equal to that of a corresponding contact portion 17 or 38.

Figure 19:
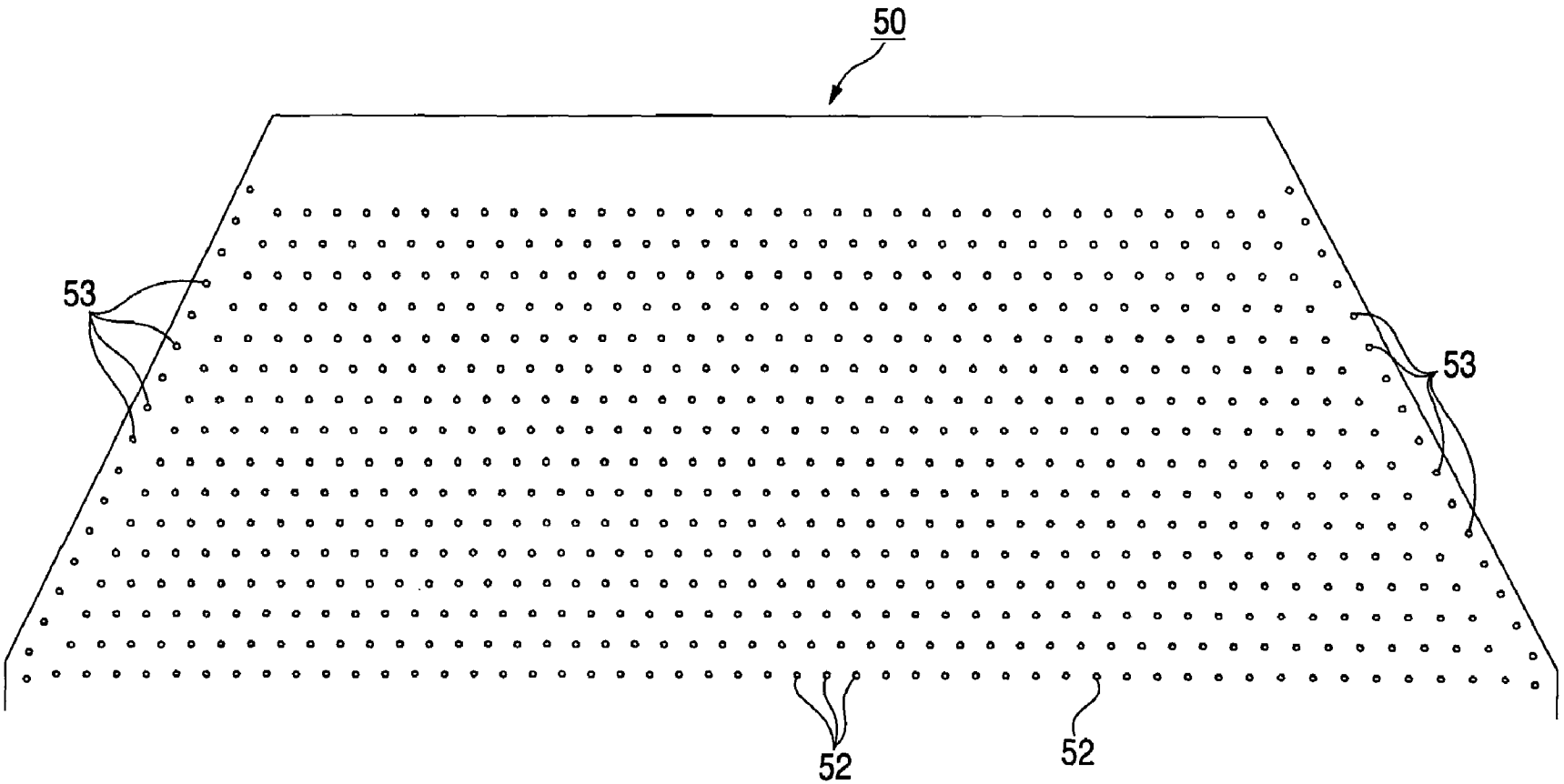
FIG. 19 is a plan view of the FPC board 50 showing arrangement of pads 52 and 53.
Figure 20:
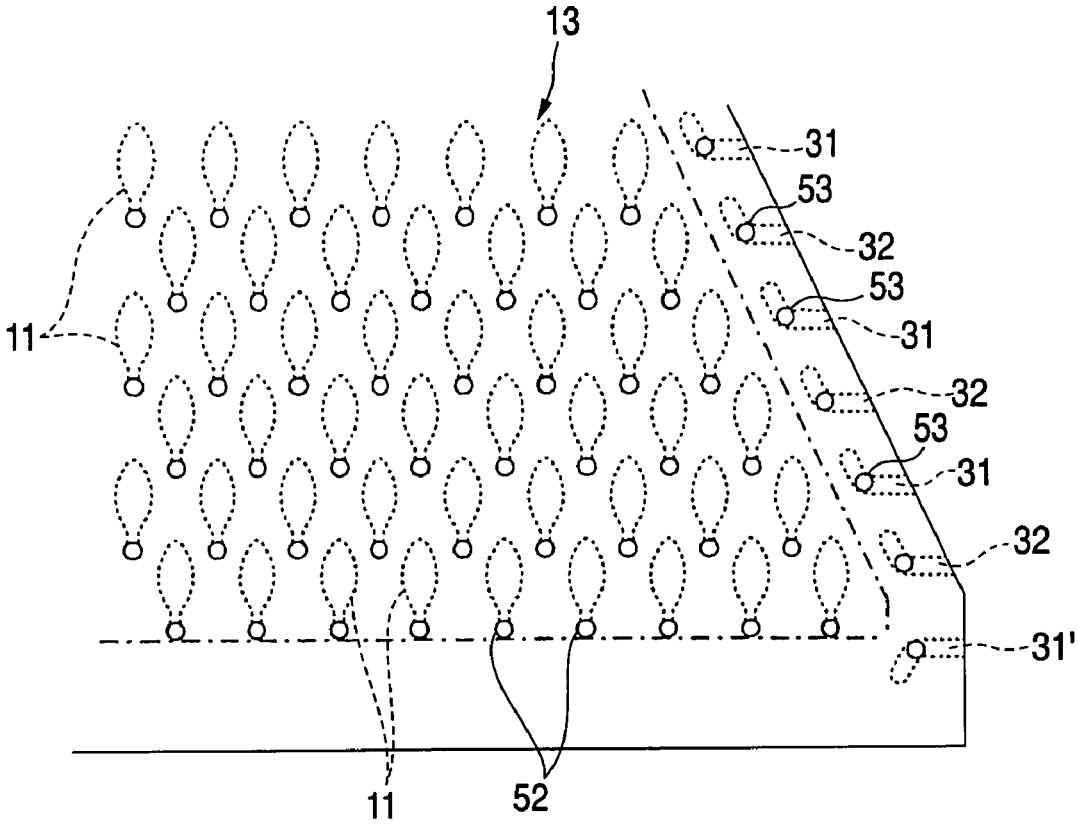
FIG. 20 is an enlarged plan view showing a right rear end portion of the front surface of the FPC board 50.
Figure 21:
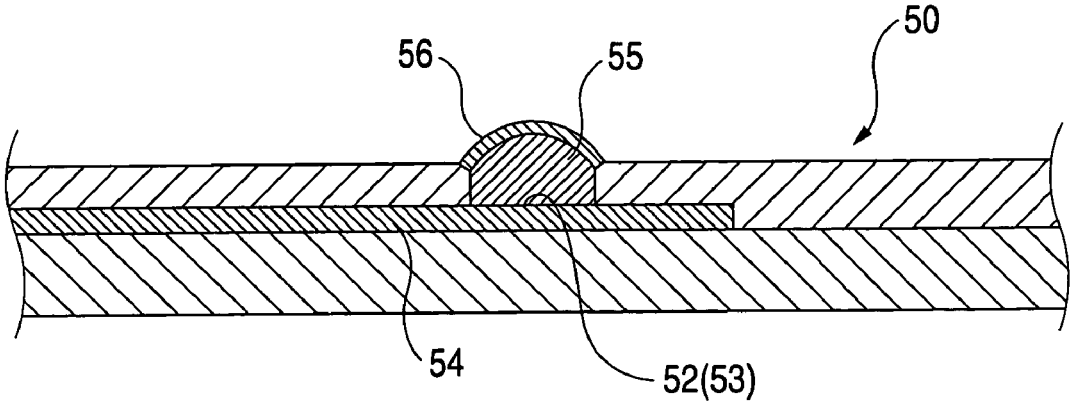
FIG. 21 is an enlarged sectional view of the FPC board 50 showing the schematic configuration of the pad 52 (or 53)
Figure 22A:
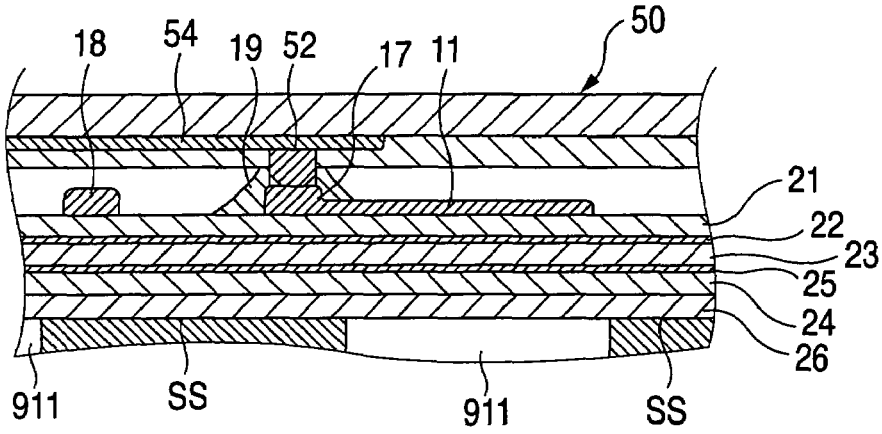
FIG. 22A is a sectional view showing a state of connection between the pad 52 of the FPC board 50 and the individual electrode 11 of the piezoelectric sheet 10.
Figure 22B:
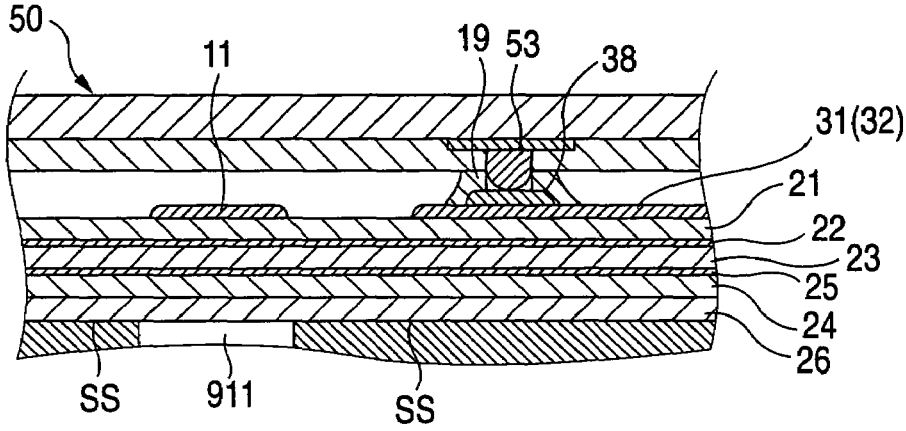
FIG. 22B is a sectional view showing a state of connection between the pad 53 of the FPC board 50 and the front surface common electrode 31 (or 32) of the piezoelectric sheet 10.
Figure 23:
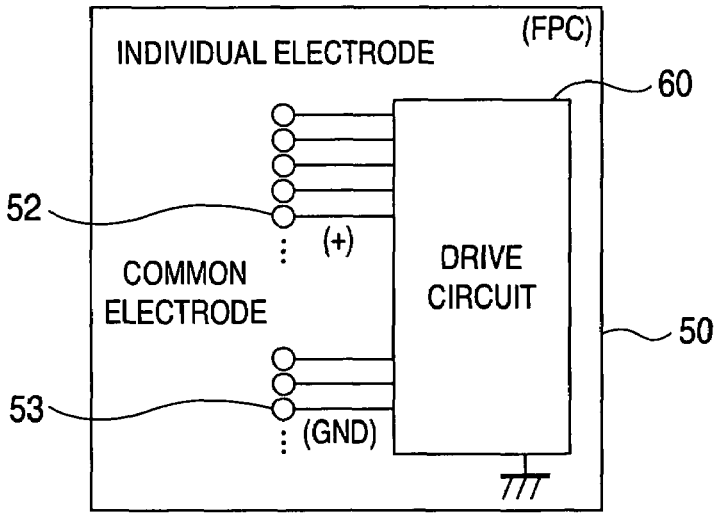
FIG. 23 is a block diagram schematically showing the electrical configuration of the FPC board 50.

Next, the schematic structure of the FPC board 50 will be described. FIG. 19 is a plan view of the FPC board 50 showing arrangement of pads 52 and 53. FIG. 20 is an enlarged plan view of a right rear end portion in a front surface of the FPC board 50. (Incidentally, in FIG. 20, individual electrodes 11 and front surface common electrodes 31, 31' and 32 as lower layers are expressed so as to be seen through). FIG. 21 is an enlarged sectional view of the FPC board 50 showing the schematic configuration of a pad 52 (53) and a wiring layer 54 provided in the FPC board 50. FIG. 22A is a sectional view showing a state of connection between the pad 52 as an individual electrode of the FPC board 50 and a corresponding individual electrode 11 of the piezoelectric sheet 10. FIG. 22B is a sectional view showing a state of connection between the pad 53 as a common electrode of the FPC board 50 and a corresponding front surface common electrode 31 of the piezoelectric sheet 10. FIG. 23 is a block diagram schematically showing the electrical configuration of the FPC board 50.

The FPC board 50 has a wiring layer 54 in its inside. An electric conductor for forming the wiring layer 54 is partially exposed to thereby form the pads 52 and 53 in the front end portion 51 of the FPC board 50. The pads 52 and 53 are connection terminals connected to the contact portions 17 and 38 of the piezoelectric sheet 10. The pads 52 and 53 are disposed to have the same pattern as the contact portions 17 and 38. That is, the pads 52 are provided in positions opposite to the contact portions 17 of the individual electrodes 11 of the piezoelectric sheet 10 respectively. A nickel plating layer 55 and a solder layer 56 are formed in each pad 52 so that the layers 55 and 56 are bonded to the contact portion 17 formed in corresponding one of the individual electrodes 11 of the piezoelectric sheet 10.

On the other hand, the pads 53 are provided in positions opposite to the contact portions 38 of the front surface common electrodes 31 and 32. A nickel plating layer 55 and a solder layer 56 are formed in each pad 53 so that the layers 55 and 56 are bonded to the contact portion 38 formed in corresponding one of the front surface common electrodes 31 (or 32) of the piezoelectric sheet 10 in the same manner as the pad 52.

When the FPC board 50 configured as described above is placed on the piezoelectric sheet 10 and soldered to the piezoelectric sheet 10 by thermo-compression bonding, the pads 52 of the FPC board 50 are bonded to the contact portions 17 of the individual electrodes 11 of the piezoelectric sheet 10 through the solder layer 56 so as to be electrically connected to the individual electrodes 11 opposite to the pads 52 respectively. On the other hand, the pads 53 are bonded to the contact portions 38 of the front surface common electrodes 31 and 32 of the piezoelectric sheet 10 through the solder layer 56 so as to be electrically connected to the front surface common electrodes 31 and 32 opposite to the pads 53 respectively. By this soldering, the FPC board 50 is fixed onto the piezoelectric sheet 10.

When soldering is made, the vicinity of the junction portion between each individual electrode 11 of the piezoelectric sheet 10 and a corresponding pad 52 is covered with N.C.P 19 which is an electrically insulating resin applied on the individual electrode 11. Similarly, the vicinity of the junction portion between each front surface common electrode 31 (or 32) of the piezoelectric sheet 10 and a corresponding pad 53 is covered with N.C.P 19 which is an electrically insulating resin applied on the front surface common electrode 31 (or 32).

As shown in FIG. 23, the FPC board 50 bonded to the piezoelectric sheet 10 in this manner has a drive circuit 60. The FPC board 50 is controlled by the control portion 3 so that a drive voltage is applied between each individual electrode 11 and a corresponding front surface common electrode 31 (or 32) on the piezoelectric sheet 10 through the pads 52 and 53 to drive the piezoelectric sheet 10.

When a drive voltage is applied to a certain individual electrode 11 by the FPC board 50, the piezoelectric layers 21, 23, 24 and 26 of the piezoelectric sheet 10 located just under the individual electrode 11 supplied with the drive voltage are deformed toward the ink pressure chamber 911 side to press ink in a corresponding ink pressure chamber 911. As a result, an ink droplet is ejected from a nozzle 111 connected to the ink pressure chamber 911.

Next, a flow of ink in the inkjet head 9 will be described. When the nozzle plate 100, the cover plate 200, the first manifold plate 300, the second manifold plate 400, the third manifold plate 500, the supply plate 600, the aperture plate 700, the base plate 800, the cavity plate 900 and the piezoelectric sheet 10 are laminated on one another in ascending order as shown in FIG. 1, the flow path of ink ejected from each nozzle 111 of the nozzle plate 100 is formed as shown in FIG. 18 which is a sectional view.

Ink ejected from the nozzle 111 of the nozzle plate 100 is first supplied from the ink tank 8 to the ink manifold flow path 2. Incidentally, the ink supply from the ink tank 8 to the ink manifold flow path 2 is performed through the ink supply path which is formed in such a manner that the ink supply holes 901 of the cavity plate 900, the ink supply holes 801 of the base plate 800, the ink supply holes 701 of the aperture plate 700, the ink supply holes 601 of the supply plate 600, the ink supply portions 515 of the third manifold plate 500, the ink supply portions 415 of the second manifold plate 400 and the ink supply portions 315 of the first manifold plate 300 are connected to one another. On this occasion, dust contained in ink is removed by the filter pores 602 in the ink supply holes 601 of the supply plate 600.

The grooving portions 512 of the third manifold plate 500, the grooving portions 412 of the second manifold plate 400 and the grooving portions 312 of the first manifold plate 300 form the ink manifold flow path 2. Ink flowing in the ink manifold flow path 2 is led into the ink pressure chambers 911 of the cavity plate 900 through the through-holes 612 of the supply plate 600, the ink inlets 713, grooving portions 715 and ink outlets 714 of the throttle portions 712 of the aperture plate 700 and the through-holes 812 of the base plate 800. On this occasion, dust contained in ink is removed by the filter pores 613 in the through-holes 612 of the supply plate 600.

When a drive voltage is applied to each of the individual electrodes 11 of the piezoelectric sheet 10 through the FPC board 50 in this state, the piezoelectric sheet 10 is deformed toward the ink pressure chamber 911 side of the cavity plate 900. On this occasion, ink in the ink pressure chambers 911 of the cavity plate 900 is pressed out into the through-holes 811 of the base plate 800.

The ink pressed out into the through-holes 811 of the base plate 800 is ejected from the nozzles 111 of the nozzle plate 100 through the through-holes 811 of the base plate 800, the through-holes 711 of the aperture plate 700, the through-hoes 611 of the supply plate 600, the through-holes 511 of the third manifold plate 500, the through-holes 411 of the second manifold plate 400, the through-holes 311 of the first manifold plate 300 and the through-holes 211 of the cover plate 200.

The inkjet printer 1 and the inkjet head 9 according to this embodiment have been described above. In this embodiment, the body portions 35 of the front surface common electrodes 31 and 32 connected to the through-holes 33 and 34 are formed so as to extend lengthwise along the outer edges of the individual electrode-forming region 13, so that the bonding area between each front surface common electrode 31 (or 32) and a corresponding pad 53 is formed as a necessary and sufficient area without widening the front surface common electrode 31 (or 32) on the individual electrode-forming region 13 side.

Particularly, in the inkjet head 9, the extension portion 36 is provided in a redundant space between each body portion 35 provided for preventing breaking of the through-hole 33 (or 34) and an end edge of the piezoelectric sheet 10. Accordingly, the area of each front surface common electrode 31 (or 32) increases efficiently, so that the front surface common electrodes 31 and 32 and the through-holes 33 and 34 can be formed so as to be efficiently separated from the individual electrode-forming region 13.

According to the inkjet head 9, electrical connection between each pad 53 of the FPC board 50 and a corresponding front surface common electrode 31 (or 32) can be kept good because the bonding area is large. In addition, unevenness in deformation of the piezoelectric sheet 10 at the time of application of a drive voltage can be prevented because the front surface common electrodes 31 and 32 and the through-holes 33 and 34 can be formed so as to be separated from the individual electrode-forming region 13. Accordingly, variation in ink ejection characteristic of the nozzles 111 can be suppressed.

Moreover, according to this embodiment, the plurality of front surface common electrodes 31 and 32 and the plurality of through-holes 33 and 34 are provided on and in the piezoelectric sheet 10 so that a plurality of connection routes are provided for connecting the pads 53 of the FPC board 50 to the inner electrodes 22 and 25. Accordingly, electrical connection between the FPC board 50 and each inner electrode 22 (or 25) can be kept better. Hence, according to this embodiment, an inkjet head and an inkjet printer high in performance and high in durability and reliability can be produced.

In this embodiment, the protrusive contact portions 17 and 38 are provided in sites which are of the individual electrodes 11 and the front surface common electrodes 31 and 32 and which are soldered to the pads 52 and 53 of the FPC board 50. When the piezoelectric sheet 10 and the FPC board 50 are soldered while disposed opposite to each other, a small gap is formed between the piezoelectric sheet 10 and the FPC board 50.

Hence, in the inkjet head 9 according to this embodiment, even in the case where small dust or the like is deposited on the piezoelectric sheet 10, the piezoelectric sheet 10 and the FPC board 50 can be prevented from being injured by the dust when the piezoelectric sheet 10 and the FPC board 50 are soldered to each other. Hence, according to this embodiment, yield in the process of production of the inkjet heads 9 can be improved.

Moreover, in this embodiment, the contact portions 17 of the individual electrodes 11 are leveled with the contact portions 38 of the front surface common electrodes 31 and 32 (with respect to the height from the front surface of the first piezoelectric layer 21 in the piezoelectric sheet 10), so that the pads 52 and 53 of the board 50 can be evenly connected to the contact portions 17 and 38. Hence, according to this embodiment, local load can be prevented from being applied on the FPC board 50 and the piezoelectric sheet 10 at the time of assembling, so that contact failure can be prevented from occurring in the contact portions 17 and 38.

Particularly, in this embodiment, the front surface areas of the contact portions 17 and 38 to be soldered are kept substantially equal to one another. Accordingly, the amounts of solder deposited on the contact portions 17 and 38 are made so uniform that the contact portions 17 and 38 can be prevented from being bonded incompletely. Hence, according to this embodiment, an inkjet head 9 high in reliability can be produced.

If the contact portions 17 of the individual electrodes 11 and the contact portions 38 of the front surface common electrodes 31 and 32 are disposed on a front surface of the piezoelectric sheet 10 opposite to the ink pressure chambers 911 (i.e. on the ink pressure chambers 911), there is a problem as described above that regions of the piezoelectric sheet 10 not supported by the cavity plate 900 are distorted and injured by pressing force which is applied on the piezoelectric sheet 10 through the contact portions 17 and 38 when the FPC board 50 is mounted on the piezoelectric sheet 10. In this embodiment, the contact portions 17 of the individual electrodes 11 and the contact portions 38 of the front surface common electrodes 31 and 32 are however disposed on the junction surface SS of the cavity plate 900 which is the surrounding region of the ink pressure chambers 911, on the front surface of the piezoelectric sheet 10. Accordingly, the piezoelectric sheet 10 can be prevented from being injured when the FPC board 50 is mounted on the piezoelectric sheet 10.

In this embodiment, the protrusions 18 are provided on the piezoelectric sheet 10 so that bonding unevenness can be suppressed in the junction surface between the cavity plate 900 and the piezoelectric sheet 10 when the piezoelectric sheet 10 is bonded to the cavity plate 900. When pressing force is applied from the upper portion of the piezoelectric sheet 10, the pressing force is transmitted to the junction surface between the piezoelectric sheet 10 and the cavity plate 900 through the contact portions 17 and 38. If there is no protrusion 18 on this occasion, the pressing force applied on part of the junction surface near the contact portions 17 and 38 becomes different from the pressing force applied on the other part of the junction surface. As a result, bonding unevenness occurs. On the contrary, in this embodiment in which the protrusions 18 are provided, the pressing force can be evenly transmitted to the junction surface between the piezoelectric sheet 10 and the cavity plate 900 through the contact portions 17 and 38 and the protrusions 18 when the pressing force is applied. Accordingly, the rear surface of the piezoelectric sheet 10 can be evenly bonded to the cavity plate 900. Because such uniform bonding can be obtained, ink ejection characteristic can be made uniform to all the nozzles 111. Accordingly, the performance of the inkjet head 9 is improved.

Incidentally, the land portions in this invention are equivalent to the front surface common electrodes 31, 31' and 32 in this embodiment. The land body portions are equivalent to the body portions 35 for forming the front surface common electrodes 31, 31' and 32. The extension portions are equivalent to the extension portions 36 for forming the front surface common electrodes 31, 31' and 32. The connection terminals of the board are equivalent to the pads 52 and 53 formed on the FPC board 50.

The inkjet head and inkjet printer according to the invention are not limited to the aforementioned embodiment and various changes may be made.

Figure 24:
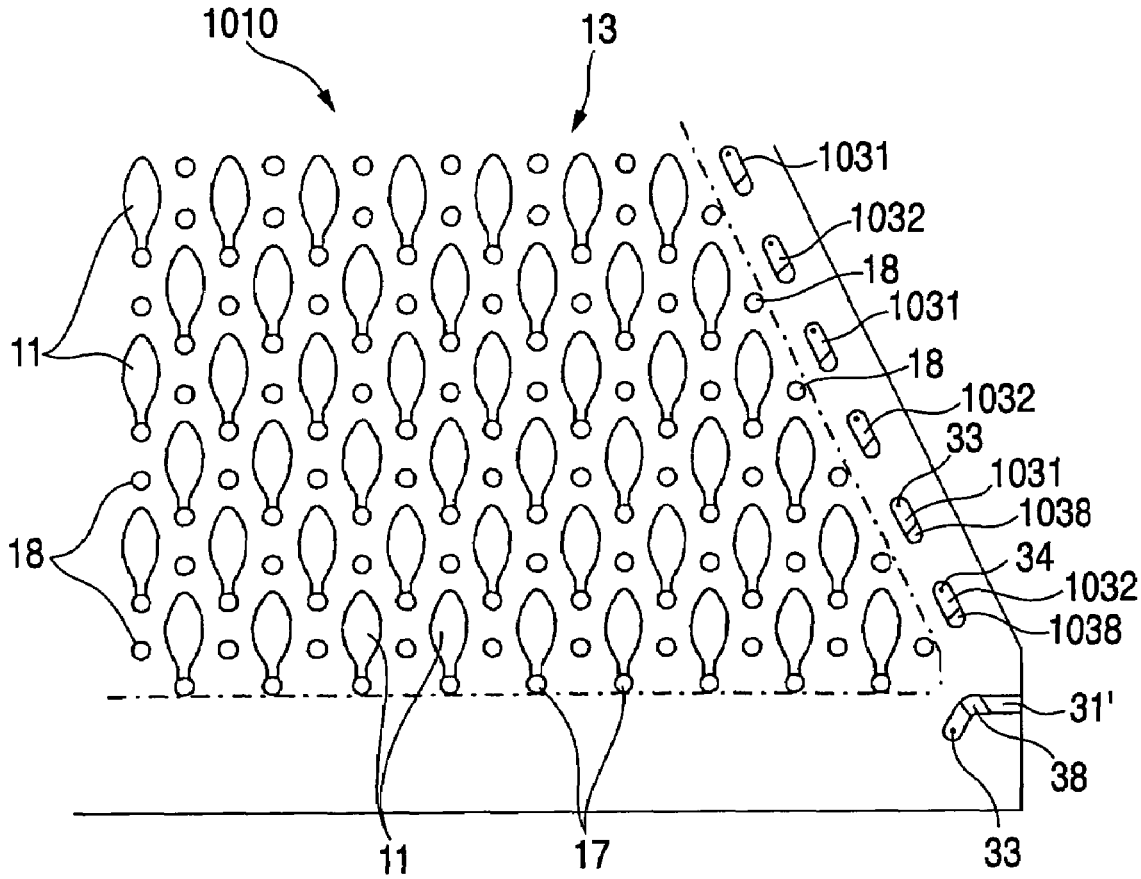
FIG. 24 is an enlarged plan view showing a right rear end portion of a front surface of a piezoelectric sheet 1010 provided as a modified example.

Although the embodiment has been described on the case where each front surface common electrode 31 (or 32) is provided as a nearly L-shaped electrode having a body portion 35 and an extension portion 36, each front surface common electrode 31 (or 32) may be provided as a linear electrode without any extension portion 36 as shown in FIG. 24. FIG. 24 is an enlarged plan view showing a right rear end portion of a front surface of a piezoelectric sheet 1010 provided as a modified example. In the modified example, front surface common electrodes 1031 and 1032 are formed so as to extend lengthwise along outer edges of the individual electrode-forming region 13. Each front surface common electrode 1031 (or 1032) has a protrusive contact portion 1038 at its one end in the lengthwise direction. The protrusive contact portion 1038 is soldered to corresponding one of the pads 53 of the FPC board 50.

Each front surface common electrode 1031 is electrically connected to the inner electrode 22 in such a manner that an end portion of the front surface common electrode 1031 opposite to the end portion connected to the pad 53 is connected to a through-hole 33 formed below the front surface common electrode 1031. Each front surface common electrode 1032 is electrically connected to the inner electrode 25 in such a manner that an end portion of the front surface common electrode 1032 opposite to the end portion connected to the pad 53 is connected to a through-hole 34 formed below the front surface common electrode 1032.

According to the inkjet head having the piezoelectric sheet 1010 configured as described above, variation in ink ejection characteristic can be suppressed while durability and reliability of products can be kept good, like the aforementioned inkjet head 9.

Although the embodiment has been described on the case where the inkjet head 9 includes the piezoelectric sheet 10 having the individual electrodes 11 two-dimensionally arranged in the form of a matrix, the invention may be applied to an inkjet head in which individual electrodes are arranged in only one direction.

Although the embodiment has been described on the case where the drive circuit 60 is provided in the FPC board 50, the drive circuit 60 may be provided separately from the FPC board 50. In this case, the FPC board 50 can be provided as a wiring board which functions as connection wiring for electrically connecting the drive circuit to the individual electrodes 11 and the front surface common electrodes 31 and 32. The arrangement of the individual electrodes 11 is not limited to the matrix form as long as it can be provided as a predetermined regular arrangement.

What is claimed is:

1. An inkjet head comprising:

a piezoelectric sheet including:

an individual electrode-forming region having individual electrodes arranged directly on a front surface of the piezoelectric sheet;

inner electrodes formed in inside of the piezoelectric sheet so as to be disposed opposite to said individual electrodes of said individual electrode-forming region; and land portions formed directly on said front surface of the piezoelectric sheet and around said individual electrode-forming region so as to be electrically connected to said inner electrodes through through-holes; and a board including connection terminals electrically connected to said individual electrodes and said land portions respectively, wherein when a drive voltage is applied between said individual electrodes of said piezoelectric sheet and corresponding land portions through said board, ink is ejected from a nozzle corresponding to said individual electrode;

said land portions are formed so as to extend lengthwise along outer edges of said individual electrode-forming region;

each of said land portions is electrically connected to corresponding connection terminals of said board in such a manner that one end portion of said land portion in the lengthwise direction is connected to said connection terminal; and each of said land portions is electrically connected to corresponding inner electrodes in such a manner that the other end portion of said land portion is connected to corresponding said through-holes formed below said land portion.

2. An inkjet head according to claim 1, wherein:

said individual electrodes are arranged in the form of a matrix in said individual electrode-forming region of said piezoelectric sheet.

3. An inkjet head according to claim 1, wherein:

each of said land portions has a land body portion formed so as to extend lengthwise along an outer edge of said individual electrode-forming region, and an extension portion extending from one end portion of said land body portion to the end edge side of said piezoelectric sheet;

each of said land portions is electrically connected to corresponding one of said connection terminals of said board in such a manner that a curved portion which is a boundary region between said land body portion and said extension portion is connected to said connection terminal; and each of said land portions is electrically connected to corresponding one of said inner electrodes in such a manner that the other end portion of said land body portion is connected to corresponding through-holes formed below said land portion.

4. An inkjet head according to claim 1, wherein:

protrusive contact portions are provided in sites which are of said individual electrodes and said land portions and which are connected to said connection terminals of said board.

5. An inkjet head according to claim 4, wherein:

said contact portions provided for said individual electrodes are substantially leveled with said contact portions provided for said land portions.

6. An inkjet head according to claim 4, wherein:

said contact portions provided for said individual electrodes and said contact portions provided for said land portions are soldered to said connection terminals provided on said board; and the front surface areas of said contact portions are made substantially equal to one another.

7. An inkjet head according to claim 4, wherein:

a cavity plate having pressure chambers located in positions corresponding to said individual electrodes and opened to the piezoelectric sheet side is bonded to a rear surface of said piezoelectric sheet; and said contact portions provided for said individual electrodes and said contact portions provided for said land portions are disposed on part of said front surface of said piezoelectric sheet opposite to a bonding surface of said cavity plate bonded to said rear surface of said piezoelectric sheet.

8. An inkjet printer including an inkjet head defined in claim 1.

9. An inkjet head according to claim 1, wherein:

a cavity plate having pressure chambers is located in positions corresponding to said individual electrodes.

10. An inkjet head according to claim 1, wherein:

contact portions of said individual electrodes are formed on said front surface.

11. An inkjet head comprising:

a piezoelectric sheet including:

a plurality of piezoelectric layers;

an individual electrode-forming region having individual electrodes arranged on a front surface of an outermost layer of the piezoelectric sheet;

inner electrodes formed on an inner layer of the piezoelectric sheet so as to be inside of the piezoelectric sheet and so as to be disposed opposite to said individual electrodes of said individual electrode-forming region; and land portions formed on said front surface of the outermost layer of the piezoelectric sheet and around said individual electrode-forming region so as to be electrically connected to said inner electrodes through through-holes; and a board including connection terminals electrically connected to said individual electrodes and said land portions respectively, wherein when a drive voltage is applied between said individual electrodes of said piezoelectric sheet and corresponding land portions through said board, ink is ejected from a nozzle corresponding to said individual electrode;

said land portions are formed so as to extend lengthwise along outer edges of said individual electrode-forming region;

each of said land portions is electrically connected to corresponding connection terminals of said board in such a manner that one end portion of said land portion in the lengthwise direction is connected to said connection terminal; and each of said land portions is electrically connected to corresponding inner electrodes in such a manner that the other end portion of said land portion is connected to corresponding said through-holes formed below said land portion.

* * * * *